US005646482A

United States Patent [19]

Suzuki et al.

[11] Patent Number: 5,646,482

[45] Date of Patent: Jul. 8, 1997

[54] ADC GAS DISCHARGE IMAGE DISPLAY DEVICE HAVING CATHODE MATERIAL DIMENSIONAL CONSTRAINTS

[75] Inventors: Shigeo Suzuki, Hirakata; Hidenobu Shintaku, Neyagawa; Taku Watanabe, Moriguchi; Mitsuo Asabe, Hirakata; Kazuo Takahashi, Takatsuki; Yoshiro Abe, Takatsuki; Hiroki Kono, Takatsuki; Kazunori Hirao, Yao, all of Japan

[73] Assignee: Matsushita Electric Industrial Co., Ltd., Kadoma, Japan

[21] Appl. No.: 454,540

[22] Filed: May 30, 1995

[51] Int. Cl.[6] ..... H01J 17/49; H01J 1/14; H01J 19/06; H01J 17/06

[52] U.S. Cl. ..... 313/582; 313/584; 313/346 R; 313/630

[58] Field of Search ..... 313/484, 491, 313/494, 582, 584, 630, 633; 445/24

[56] References Cited

U.S. PATENT DOCUMENTS

| | | | |
|---|---|---|---|
| 4,393,326 | 7/1983 | Kamegaya et al. | 313/582 |
| 4,554,482 | 11/1985 | Kamegaya et al. | 313/582 |
| 4,703,225 | 10/1987 | Sohn | 313/587 |
| 5,123,847 | 6/1992 | Holmberg et al. | 437/48 |

FOREIGN PATENT DOCUMENTS

| | | |
|---|---|---|
| 0450547 | 10/1991 | European Pat. Off. . |
| 3-289025 | 12/1991 | Japan . |
| 4072057 | 3/1992 | Japan . |
| 4-286836 | 10/1992 | Japan . |
| 4-301063 | 10/1992 | Japan . |
| 5-11382 | 2/1993 | Japan . |
| 5-89786 | 4/1993 | Japan . |
| 5-242812 | 9/1993 | Japan . |
| 6-150830 | 5/1994 | Japan . |

OTHER PUBLICATIONS

Search Report for European Appl. 95108422.7, mailed Oct. 3, 1995.

*Primary Examiner*—Sandra L. O'Shea
*Assistant Examiner*—Mack Haynes
*Attorney, Agent, or Firm*—Renner, Otto, Boisselle & Sklar

[57] ABSTRACT

In a DC gas discharge type image display apparatus including: a front glass substrate; a rear glass substrate facing the front glass substrate, interposing a discharge gas therebetween; a set of anodes including a plurality of line electrodes formed on the rear glass substrate; a set of cathodes including a plurality of line electrodes placed on the front glass substrate so as to perpendicularly cross the set of anodes; and a plurality of discharge cells, each being provided so as to correspond to each of the cross points of the set of anodes and the set of cathodes, the apparatus being driven in a refresh driving method or a memory driving method, the set of cathodes are formed by a spraying method. The cathodes are made from aluminum, nickel, an aluminum alloy or a nickel alloy. The discharge gas is a mixed gas of He and Xe.

13 Claims, 20 Drawing Sheets

FIA.7A
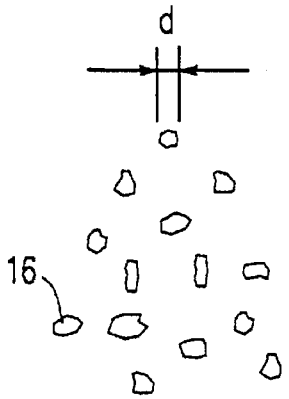
FIB.7B
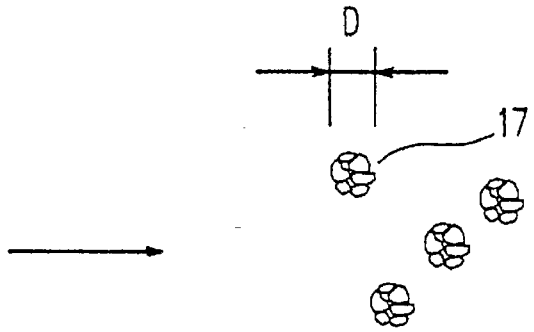
FIA.8A
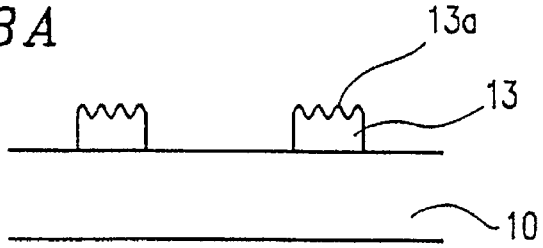
FIB.8B
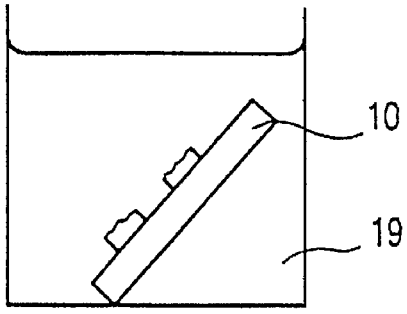
FIC.8C
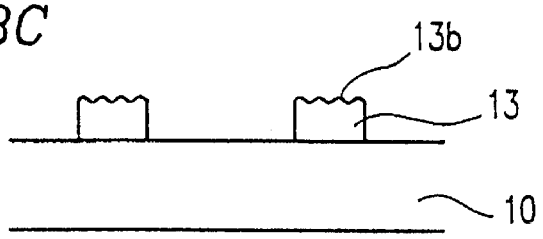

ADC GAS DISCHARGE IMAGE DISPLAY DEVICE HAVING CATHODE MATERIAL DIMENSIONAL CONSTRAINTS

BACKGROUND OF THE INVENTION

1. Field of the Invention

The present invention relates to an image display apparatus and a method for fabricating the same; specifically, to an image display apparatus utilizing light emission from a rare gas discharge, which is used for a color television image receptor, a display and the like, and a method for fabricating the same. In particular, the present invention relates to a discharge electrode used in such an image display apparatus and a method for fabrication the same.

2. Description of the Related Art

Gas discharge type image display apparatuses such as a plasma display panel (hereinafter, referred to as "PDP") have been utilized as plane type image display apparatuses in information terminal equipment such as a computer. Since the PDPs are advantageous in clear image display and a wide viewing angle as compared with a liquid crystal panel, their application is extended.

As the television image receptor is made larger in size, projection type televisions using a Braun tube and a liquid crystal panel are more and more commercialized. However, such conventional projection type televisions have problems in luminance of the picture and size of the device.

On the other hand, the PDP has drawn attention as an image display device which can be remarkably thinned. Moreover, a technique for obtaining multi-color images in the PDP has been remarkably improved. As a result, the PDP attracts attention as a frontier of the image display device to realize a direct-view type wall-television with high definition. Such a condition requires precise reproducibility and for the life of the PDP to improve.

FIG. 20 is a perspective view showing the configuration of a typical DC type PDP 500.

The DC type PDP 500 includes: a front glass substrate 39 and a rear glass substrate 40 which are made of transparent glass and the like; and a plurality of discharge cells 41 constituted therebetween. A fluorescent material 42 emitting a light beam of a predetermined color is provided inside each of the discharge cells 41. A gas discharge occurs inside each of the discharge cells 41 so as to generate an ultra-violet ray, and the thus generated ultra-violet ray is radiated onto the fluorescent material 42, thereby performing a color display.

Specifically, a plurality of cathode lines 43 are formed on the surface of the front glass substrate 39, which faces the rear glass substrate 40, so as to be parallel to each other. A plurality of anode lines 44 are formed on the surface of the rear glass substrate 40, which faces the front glass substrate 39, so as to be parallel to each other and perpendicularly cross the cathode lines 43. Each of the cross points of the cathode lines 43 and the anode lines 44 corresponds to a single discharge cell 41. Each of the discharge cells 41 is separated from another discharge cell 41 by a partition wall 45 and forms a fine discharge tube. The fluorescent materials 42 respectively corresponding to red (R), green (G) and blue (B) are applied onto the respective discharge cells 41 in an appropriate arrangement. The partition wall 45 keeps the distance between the front glass substrate 39 and the rear glass substrate 40 at a predetermined value and prevents the colors of the adjacent discharge cells 41 from being mixed.

An insulating layer 46 is formed on the rear glass substrate 40. The insulating layer 46 is formed so as to expose the anode lines 44 at positions corresponding to the respective discharge cells 41 and to cover the anode rays 44 in the other region. A cell resistance (not shown in FIG. 20) for limiting the discharge current may be provided for each of the discharge cells 41.

A discharge gas for radiating an ultra-violet ray is sealed within each of the discharge cells 41. For example, a mixture of helium and xenon is sealed within the discharge cells 41 so that the gas pressure in the sealed cells 41 can reach about several hundreds Torr.

In the DC type PDP 500 having the above configuration, when a voltage is applied between an arbitrarily selected cathode line 43 and an arbitrarily selected anode line 44, a discharge occurs in the discharge cell 41 at the position corresponding to the cross point thereof. More specifically, electrons are emitted from the cathode lines 43 to reach the anode lines 44 while ionizing the discharge gas inside the discharge cells 41. The voltage applied for generating such a discharge is referred to as a writing voltage. The fluorescent materials 42 are excited by the ultra-violet rays generated by the ionization of the discharge gas which attends the discharge, whereby light beams in predetermined colors are emitted in each cell 41. In this way, a color display is performed.

FIG. 21 shows a method for applying a voltage pulse in the case where the DC type PDP 500 shown in FIG. 20 is driven by a refresh driving method.

The DC type PDP 500 includes cathode lines 43K1 to 43Kn, i.e., n cathode lines in total (collectively denoted by the reference numeral 43) and anode lines 44A1 to 44Am, i.e., m anode lines in total (collectively denoted by the reference numeral 44). Each of the cross points of the cathode lines 43 and the anode lines 44 corresponds to each of the discharge cells 41.

In the refresh driving method, a negative pulse voltage 48 is sequentially applied to the cathode lines 43K1 to 43Kn in a time-division manner so as to sequentially select the cathode lines 43. This operation is called scanning, and the cathode lines 43 may be called scanning lines.

Subsequently, the anode lines 44 corresponding to the discharge cells 41 which are expected to emit light beams are selected from the discharge cells 41 along the selected cathode lines 43 in a synchronous manner with the selection of any one of the cathode lines 43. This selection is performed by applying a positive pulse voltage 51 to the anode lines 44 to be selected. Therefore, if all anode lines 44 are simultaneously selected, all discharge cells 41 on one of the cathode lines 43 are simultaneously selected to emit light. By appropriately selecting the anode lines 44 in accordance with the information to be displayed by the selected cathodes lines 43, light can be emitted in an arbitrary pattern. In this way, an operation as an image display device is realized.

In the refresh driving method, light-emission occurs only when the writing voltage is applied, and an image is displayed by utilizing the thus emitted light. As the number of cathode lines 43 increases, the time period for a pulse application to each of the cathode lines 43 is shortened. Accordingly, the light-emission time in each of the cathode lines 43 is shortened in inverse proportion to the number of cathode lines 43. As a result, as the number of cathode lines 43 increases, the luminance of the image to be displayed is lowered.

A memory driving method is used to solve the above problems in the refresh driving method.

Generally, when the discharge occurs in the discharge cells 41 due to application of the writing voltage, charged particles remain in the discharge cells 41. Owing to these charged particles, even if the application of the writing voltage is stopped, a discharge can be maintained at a lower voltage (Vm) than the initial writing voltage (Vw) over a predetermined time period (normally, several micro seconds). The memory driving method operates the PDP by utilizing this phenomenon.

FIG. 22 shows a method for applying a voltage pulse in the case where the DC type PDP 500 shown in FIG. 20 is driven by the memory driving method.

Similarly to the refresh driving method, in the memory driving method, a writing voltage 54 of an amplitude Vw is selectively applied to predetermined discharge cells 43 by applying a negative pulse voltage 52 to the cathodes and a positive pulse voltage 53 to the anodes, thereby generating a discharge. In addition, after the application of the writing voltage 54, a maintaining pulse voltage 55 of an amplitude Vm is subsequently applied to the cathodes so as to prolong the discharge time period.

As described above, in the memory driving method, continuous light emission can be obtained by application of the maintaining pulse voltage 55 regardless of the number of cathode lines. Therefore, the luminance of the image to be displayed can be further enhanced as compared with the refresh driving method utilizing a light emission obtained only by application of the writing voltage. For example, the luminance of 150 cd/m$^2$ or more, which is a sufficient value for television display, is accomplished.

The amplitude Vm of the maintaining pulse 66 is required to be set to a voltage Vpd or higher at which the discharge occurs (the discharge cells lighten) in the case where the writing voltage 54 is applied prior to the application of the maintaining voltage 55 and to a voltage Vxt or lower at which the discharge does not occur (the discharge cells do not lighten) in the case where the writing voltage 54 is not applied prior to the application of the maintaining voltage 55. The difference between these voltages (Vxt–Vpd) is called the memory margin and is generally about 20 V.

In the memory driving method, it is important to obtain a stable discharge voltage for realizing a stable operation of the DC type PDP. The discharge voltage is greatly affected by the cathode lines 43. Therefore, the cathode lines 43 are very important constituent components in the DC type PDP for reduction in power while the PDP is lightened, long-term stability of operation and reservation of the memory margin.

The cathode lines 43 may be formed of various materials such as metals and oxides. Conventionally, the cathode lines 43 are formed of Ni or an alloy thereof, mainly by screen printing.

Furthermore, a material having a low work function is deposited on the surface of the metal electrodes formed by screen printing in order to reduce the discharge voltage so as to reduce the power consumption of the DC type PDP. For example, Japanese Patent Publication Nos. 2-7136, 5-11381 and 5-11382 disclose such a structure.

FIGS. 23A and 23B schematically show the structure of cathode lines 59 disclosed in Japanese Patent Publication No. 2-7136. FIG. 23A is a cross-sectional view taken along a line 23A–23A' shown in FIG. 23B.

The cathode line 59 includes a base metal 56 and a porous adhesive layer 57 formed thereon. The base metal 56 is formed into a predetermined pattern (for example, in a stripe pattern in FIG. 23B) by screen printing. The porous adhesive layer 57 made of an oxide or a sulfide of alkaline earth metal elements, or a composite metal oxide of alkaline earth metal elements and aluminum is formed on the base metal 56 by a plasma spraying method in a predetermined pattern corresponding to the arrangement of the discharge cells. In FIG. 23B, the porous adhesive layer 57 is formed in a round shape. At least free alkaline earth metal elements 58 are present in a studded manner inside the pores of the porous adhesive layer 57.

In such a structure, an electrically insulating material or a material having a high melting point and a low work function is used as an electron-emitting material. By using the electron-emitting material, the discharge voltage is lowered, resulting in reduced power consumption. In the above-mentioned example, the oxide or the sulfide constituting the porous adhesive layer 57 is such a material of a low work function, which serves as the electron-emitting material.

In the case where the porous adhesive layer 57 made of these materials is formed by screen printing, in order that the porous adhesive layers 57 actually function as the cathode lines, it is necessary to perform a melting process and an activating process at a significantly high temperature after forming the porous adhesive layer 57 into a predetermined shape by screen printing, as a step for promoting the generation of free metal elements. On the other hand, in the case where the porous adhesive layer 57 is formed by the plasma spraying method, it is unnecessary to perform a high-temperature process since the plasma spraying step itself is performed at a high temperature. Thus, a cathode line of a low discharge voltage can be formed without applying a large heat load to the glass substrate after depositing the base metal 56 and the porous adhesive layer 57 on the glass substrate.

If the cathode lines are mainly formed by screen printing as described above, the DC type PDP can be fabricated using a relatively simple fabrication device. On the other hand, however, the formation of the cathode lines by screen printing has the following problems.

(1) Voltage drop due to the line resistance of the cathode lines:

Generally, in the DC type PDP, the cathode lines are sequentially scanned. In this process, if a number of discharge cells on one cathode line are simultaneously selected to be lightened, the current flowing through the discharge flows into the power source via the cathode line. Thus, a difference in voltage due to the line resistance of the cathode line is generated between an end on the power supply side and an end opposite thereto of the cathode line. As a result, as a distance from the power supply side becomes larger, the voltage which is actually applied to the discharge cells is lowered.

In the refresh driving method, this voltage difference appears as a luminance difference. Thus, the quality of the image to be displayed is degraded. In the case of the memory driving method, the memory margin is significantly deteriorated due to the voltage difference.

For example, a discharge current flowing into each discharge cell is about 60 μA, when the electrode pitch is 200 μm, the size of the cathode is 575 μm (length)×150 μm (width), and He-Xe 10% is sealed, as the discharge gas, within the discharge cell under the pressure of 350 Torr. A sheet resistance of the cathode line having a thickness of 50 μm formed of an aluminum print paste becomes about 40 mΩ. When the DC type PDP having about 900 anodes, which are necessary to an NTSC mode wide television, is constituted under the above conditions, the voltage difference between the power supply side end and the opposite side end of the cathode line is about 6 V. This implies that the memory margin is lowered by about 6 V at the opposite side end as compared with the power supply side end of the cathode line.

In this way, the line resistance bringing about a large voltage drop is one of the reasons for the lowered memory margin.

In the case where the cathode line is formed by screen printing, a metal paste for printing (glass frit) formed by mixing a binder such as a glass powder with a metal powder is generally used. Therefore, when the cathode line is formed by baking the paste which is screen printed into a predetermined pattern, the surfaces of metal particles are covered with the melted glass. As a result, the electric conductivity in the cathode line is lowered to about a fraction of that of metal, resulting in an increased line resistance. Therefore, in the cathode lines formed by screen printing, as the screen becomes larger, the line resistance increases because of conspicuous effects of the glass frit. This leads the degree of the voltage drop due to the current flowing through the cathode lines to be large. As a result, the quality of the image to be displayed is degraded, for example, the luminance in a length direction of the cathode line is lowered or some discharge cells are not lightened. In order to solve these problems, a driving voltage circuit is required to be large in scale. Consequently, it is difficult to reduce the fabrication cost or the size.

(2) Variation in a driving voltage during a lightening time period:

In the memory driving method for driving the PDP within a limited driving voltage range, it is necessary to limit the variation in the driving voltage during the lightening time period to a value as small as possible. However, in the case where, for example, a PDP having aluminum cathodes formed by screen printing is driven by the memory driving method, the driving voltage varies by about 15 V until the driving time period (aging time) reaches 30 thousand hours, for which a television for domestic use should be driving. As a result, the memory margin is remarkably lowered (by −15 V) during the lightening time period. As described above, the surfaces of the cathode lines formed by screen printing are generally covered with glass contained in the paste. As this glass coating is removed by the discharge during the driving, clean metal surfaces gradually appear, thereby varying the driving voltage.

Thus, in order to reduce the line resistance and the variation in the driving voltage during the lightening time period, the cathode lines of the DC type PDP are required to be formed in the state as close as possible to a pure metal.

Although it is also possible to form the cathode lines by vapor deposition, the vapor deposition method has problems in that a formable film is too thin to obtain a predetermined line resistance and the fabrication cost increases since a vacuum vapor deposition apparatus is needed.

In the plasma spraying method, a powdery cathode line material is blown into a jet stream in the high-temperature plasma state to melt the powdery material. The powdery material in the melted state is then adhered to the substrate at a high speed utilizing the energy of the jet stream. Therefore, the glass frit does not basically enter the cathode material, which was a problem in the screen printing method.

However, there is a problem in the process peculiar to the spraying method. In particular, in the case of the spraying utilizing powdery particles of a low specific weight or in the case where a fine pattern is formed over a large area, there arise many problems due to the principle of the spraying method. Therefore, the spraying method cannot be put into practical use as a method for forming the cathode line of the DC type PDP with high accuracy.

FIG. 24 schematically shows a method for forming the cathode line by plasma spraying. A glass substrate 60 serving as a front glass substrate of the PDP is directly put on a mounting table 65 made of metal and the like. Cathode line material particles 52 at a high temperature are collided at a high speed against the glass substrate 60 from a plasma spraying torch 61 provided above the glass substrate 60, thereby forming a thick film made of cathode line material on the surface of the glass substrate 60. The torch 61 or the substrate 60 is sequentially traversed in a direction indicated by an arrow 64 shown in FIG. 24 so as to perform spraying on the entire surface of the glass substrate 60. In this case, the actual cathode lines 63 are generally formed by using a lift-off method or the like from the thus formed thick film.

In the above conventional plasma spraying method, however, it is difficult to form the cathode lines 63 with a fine pitch and a fine width over the entire surface of the glass substrate 60 without disconnection. Although the glass substrate 60 on which the cathode lines 63 are formed is generally large in size, i.e., about 1 m×1 m, the thickness thereof is typically small, i.e., about 2 to 3 mm. When the plasma spraying is performed on such a thin and large glass substrate 60, a difference in temperature occurs between the region where the film deposition is currently being conducted by spraying and the remaining region. The glass substrate 60 may be broken by the thermal stress caused by such a temperature difference. Furthermore, since it is difficult to obtain a uniform thickness over the entire surface of the glass substrate 60, discharge characteristics may not be uniform. In particular, in the case where the narrow cathode lines 63 are to be formed over a large area using a metal of a small specific weight, it is difficult to attain appropriate characteristics of the cathode lines 63.

The problem described in the above point (1) similarly occurs in the case where the cathode lines are formed by using a spraying process. This is because, in the case where the cathode line is formed using the spraying process in a conventional method, a bus line (base metal) of the cathode line is formed by screen printing and the surface thereof is covered with the electron-emitting material by a spraying method.

SUMMARY OF THE INVENTION

According to one aspect of the invention, a DC gas discharge type image display apparatus includes: a front glass substrate; a rear glass substrate facing the front glass substrate, interposing a discharge gas therebetween; a set of anodes including a plurality of line electrodes formed on the rear glass substrate; a set of cathodes including a plurality of line electrodes placed on the front glass substrate so as to perpendicularly cross the set of anodes; and a plurality of discharge cells, each being provided so as to correspond to each of cross points of the set of anodes and the set of cathodes, wherein the line electrodes included in the set of cathodes are formed by a spraying method for spraying particles of a predetermined cathode material from a spraying device toward a glass substrate.

In one embodiment, the line electrodes included in the set of cathodes are formed on bottom faces of grooves which are formed on a surface of the front glass substrate.

In another embodiment, the cathode material is selected so that an average diameter d of a primary particle supplied to the spraying device is set in a range, upper limit thereof being a smaller value of h/2 and W/9 and lower limit thereof being 10 μm, where each of the line electrodes included in the set of cathodes has a width W and a thickness h.

In still another embodiment, the spraying method is a plasma spraying method.

In still another embodiment, the cathode material is selected from a group consisting of aluminum, nickel, an aluminum alloy and a nickel alloy.

In still another embodiment, the discharge gas is a mixed gas of He and Xe.

In still another embodiment, each of the line electrodes included in the set of cathodes is formed by laminating sprayed particles of the cathode material in a flattened manner.

In still another embodiment, each of the line electrodes included in the set of cathodes includes: a metal bus line formed by the spraying method; and an upper coating film made of a material selected from a group consisting of a metal, a metallic oxide and a metallic sulfide, the upper coating film being formed on a surface of the metal bus line. Preferably, the upper coating film is formed by the spraying method. The oxide may be $La_{1-x}Sr_xMO_3$ (where M is Co or Mn) having a perovskite structure. The metal bus line may be formed by laminating sprayed particles in a flattened manner.

In still another embodiment, the set of cathodes are formed by further being subject to a baking process at a temperature of 400° C. or higher after execution of the spraying method.

According to another aspect of the invention, in a method for fabricating a DC gas discharge type image display apparatus including: a front glass substrate; a rear glass substrate facing the front glass substrate, interposing a discharge gas therebetween; a set of anodes including a plurality of line electrodes formed on the rear glass substrate; a set of cathodes including a plurality of line electrodes placed on the front glass substrate so as to perpendicularly cross the set of anodes; and a plurality of discharge cells, each being provided so as to correspond to each of cross points of the set of anodes and the set of cathodes, a step of forming the set of cathodes includes the steps of: (a) forming a mask film on a surface of a glass substrate; (b) forming an opening in a predetermined pattern through the mask film; (c) depositing a sprayed film serving as the line electrodes included in the set of cathodes at a portion of a surface of the glass substrate, which corresponds to the opening, by spraying a predetermined cathode material from a spraying torch placed above the surface of the mask film and moving at least one of the spraying torch and the glass substrate in a predetermined pattern; and (d) removing the mask film from the surface of the glass substrate.

In one embodiment, the step (c) further includes a step of roughening the portion of the surface of the glass substrate, the portion corresponding to the opening.

In another embodiment, the step (c) further includes a step of forming a groove having a predetermined depth on the portion of the surface of the glass substrate, the portion corresponding to the opening, and the sprayed film is deposited on a bottom face of the groove.

In still another embodiment, the spraying step is carried out in the step (c) while the glass substrate is placed on a mounting table with a heat insulating means interposed therebetween.

In still another embodiment, a deposition rate of the sprayed film is kept substantially constant with elapse of a spaying time in the step (c) by controlling either a supply rate of the cathode material from the spraying torch, or a moving rate of at least one of the spraying torch or the glass substrate.

Thus, the invention described herein makes possible the advantages of: (1) providing a DC gas discharge type image display apparatus having a low-resistance cathode line which has a clean metal surface and shows little variation in its driving voltage while driven for a long period of time; and (2) providing a method for fabricating the same.

These and other advantages of the present invention will become apparent to those skilled in the art upon reading and understanding the following detailed description with reference to the accompanying figures.

BRIEF DESCRIPTION OF THE DRAWINGS

FIGS. 7A and 7B schematically show the changes in the shape of material particles to be sprayed due to the execution of a processing step therefor.

FIGS. 8A to 8C schematically show a method for fabricating a cathode line of a DC type PDP in Example 2 according to the present invention.

FIG. 18 is a graph showing the relationships between the substrate temperature, the thickness of a sprayed film, the supply rate of material to be sprayed and the spraying time in the case where cathode lines are formed on a glass substrate by plasma spraying.

DESCRIPTION OF THE PREFERRED EMBODIMENTS

EXAMPLE 1

Figure 1:
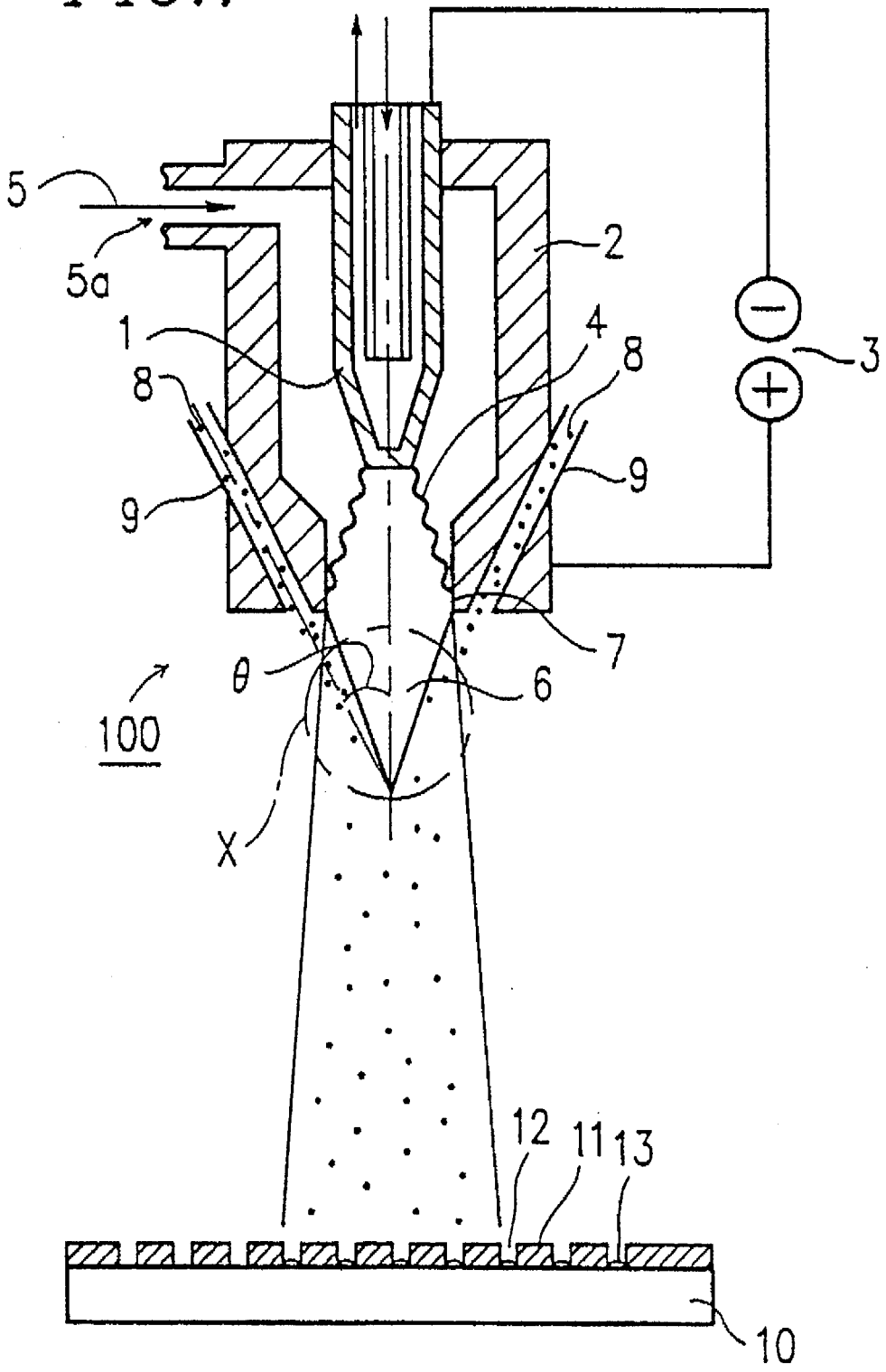
FIG. 1 schematically shows a method for producing a cathode line of a DC type PDP in Example 1 according to the present invention.

FIG. 1 schematically shows a method for producing a cathode line of PDP according to a first example of the present invention. Specifically, the cathode line made of metal aluminum is formed on a glass substrate using a plasma spraying method.

A plasma spraying torch 100 includes a water-cooled cathode 1 and a water-cooled anode 2. A DC voltage is applied between the cathode 1 and the anode 2 by a power source 3 so as to generate an arc discharge 4. A plasma working gas 5 is supplied from a supply port 5*a* thereof which is provided at the rear part of the plasma spraying torch 100. The supplied plasma working gas 5 is heated and ionized by the arc discharge 4 generated between the cathode 1 and the anode 2 so as to be jetted out of a nozzle 7 as a plasma jet 6. Argon, helium, hydrogen and the like can be used as the plasma working gas 5. For example, argon is used in Example 1.

A material 8 to be sprayed which serves as a material of the cathode line is carried by a carrier gas from a supply port 9 in a powdery state so as to be blown into the plasma jet 6. The material 8 to be sprayed mixes with the plasma jet 6 in the vicinity of a region X of FIG. 1, which corresponds to the outside of the nozzle 7. As a result, the material 8 is heated and melted and then accelerated by the energy of the plasma jet 7 to collide against the surface of a glass substrate 10 at a high speed. With this condition, a coating is formed on the surface of the glass substrate 10.

The glass substrate 10 functions as a surface glass (front glass) of the image display device (PDP). For example, a soda glass substrate having a thickness of about 2 mm is used as the glass substrate 10. A mask film 11 having openings 12 corresponding to a pattern of cathode lines 13 to be formed as shown in FIG. 1 is attached to the surface of the glass substrate 10. By performing the spraying from the upper side of the glass substrate 10 through the mask film 11, the cathode lines 13 having a predetermined thickness are formed only on the portions of the surface of the glass substrate 10, which correspond to the bottom faces of the openings 12. By pealing off the mask film 11 after the film deposition by the spraying, the glass substrate 10, on which the cathode lines 13 are formed into a predetermined pattern, is obtained. The thickness of the mask film 11 is set to about 50 μm, a little thicker than that of the cathode lines to be formed.

The material 8 to be sprayed in Example 1 is metal aluminum powder having a purity of 99%. An average particle size of the powder is about 20 μm.

In the case where an aluminum powder having an average diameter of about 20 μm is blown into the plasma jet 6 as the material 8 to be sprayed, it is desirable for the material 8 to enter into the plasma jet 6 at a small incident angle. In the plasma spraying torch 100 of FIG. 1, in view of structural restrictions thereof, the incident angle θ is set to 30°.

If a plurality of the supply ports 9 of the material 8 are provided in the periphery of the nozzle 7 at equal intervals, the distribution of the plasma jet 6 and the mixing condition of the material 8 therein can be uniform. Therefore, the cathode lines (sprayed film) 13 having better quality can be formed.

The cathode lines (sprayed film) can be formed by arc spraying instead of the plasma spraying. However, in order that the cathode lines having a fine pattern are accurately formed and strongly adhered to the glass substrate, the plasma spaying method is preferred. Moreover, in the plasma spraying method, various materials can be dealt with good controllability.

FIGS. 2A to 2F show the process of forming the cathode lines on the front glass substrate by the plasma spraying method according to the present invention.

Figure 2A:
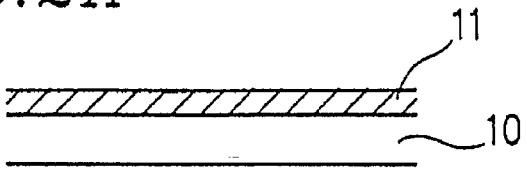
FIGS. 2A to 2F are cross-sectional views showing the respective fabrication steps of the cathode lines in the PDP in Example 1 according to the present invention.
Figure 2B:
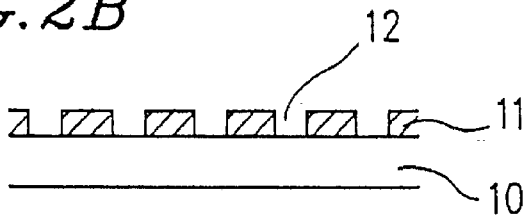

First, as shown in FIG. 2A, the mask film 11 is attached onto the surface of the glass substrate 10. As the mask film 11, for example, a dry film which is commercially available from TOKYO OHKA KOGYO, Co., Ltd. under the general trade designation "BF series" can be used. Next, as shown in FIG. 2B, openings 12 are formed into a pattern corresponding to the cathode line pattern to be formed on the mask film 11 by an exposing process and an etching process.

Figure 2C:
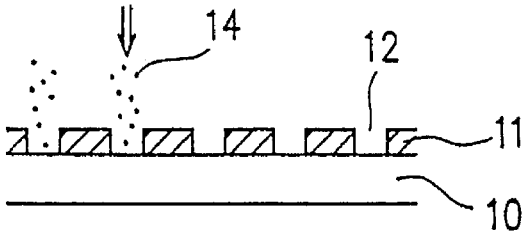
Figure 2D:
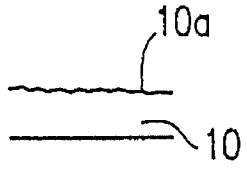

Then, as shown in FIG. 2C, blast particles 14 are made to collide against the upper surface of the glass substrate 10 through the mask film 11 on which the openings 12 are formed, thereby conducting a sand blast processing. By this send blast processing, as shown in FIG. 2D, surfaces 10*a* of the portions, which correspond to the openings 12, of the surface of the substrate 10 are roughened. A preferable surface roughness of the thus obtained rough surface 13*a* is typically about 1 in center line average height Ra, although it depends on the material to be sprayed and conditions under which the spraying process is conducted.

Figure 2E:
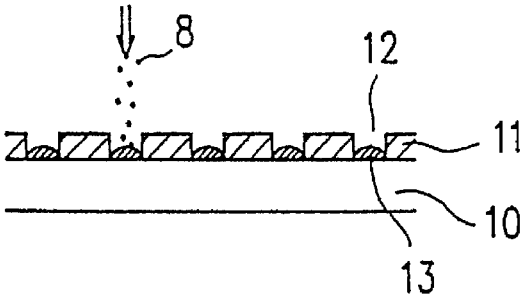
Figure 2F:
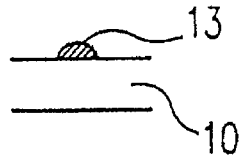

Next, as shown in FIG. 2E, the material 8 is made to collide against the surface of the glass substrate 10 by the plasma spraying through the openings 12 formed through the mask film 11, thereby forming a film made of cathode material. As a result, a sprayed film i.e., a cathode line 13, is formed on the surface of the glass substrate 10 with strong adhesion corresponding to the openings 12. On the other hand, the sprayed particles which reach the surface of the mask film 11 recoil due to the elasticity of the mask film 11. Therefore, the sprayed film 13 is not formed on the surface of the glass substrate 10 other than the portions corresponding to the openings 12. The mask film 11 is pealed off after the completion of the spraying process, and the cathode lines 13 having a predetermined pattern are formed on the surface of the substrate 10, as shown in FIG. 2F.

Figure 20:
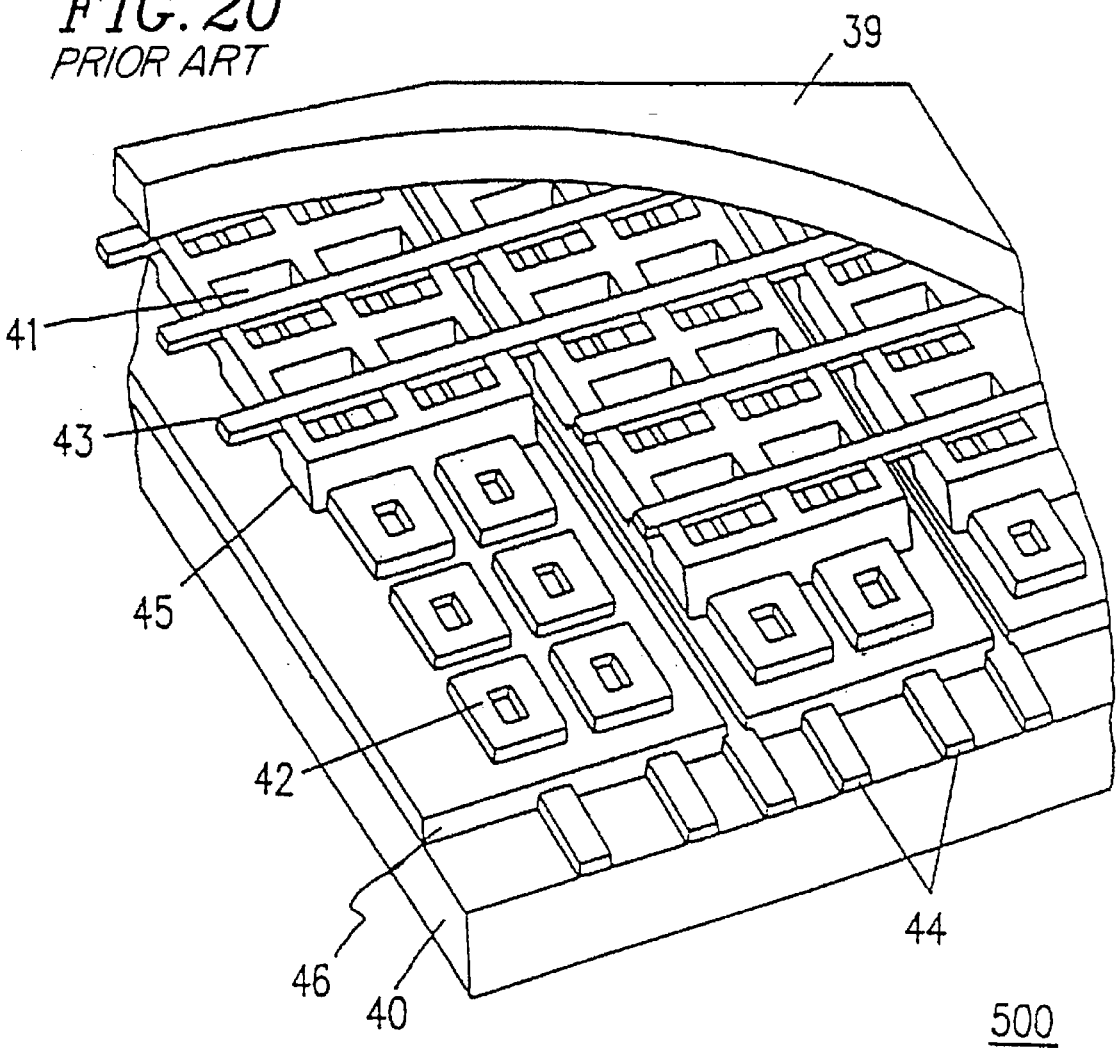
FIG. 20 PRIOR ART
FIG. 20 is a perspective view showing the configuration of a DC type PDP.
Figure 21:
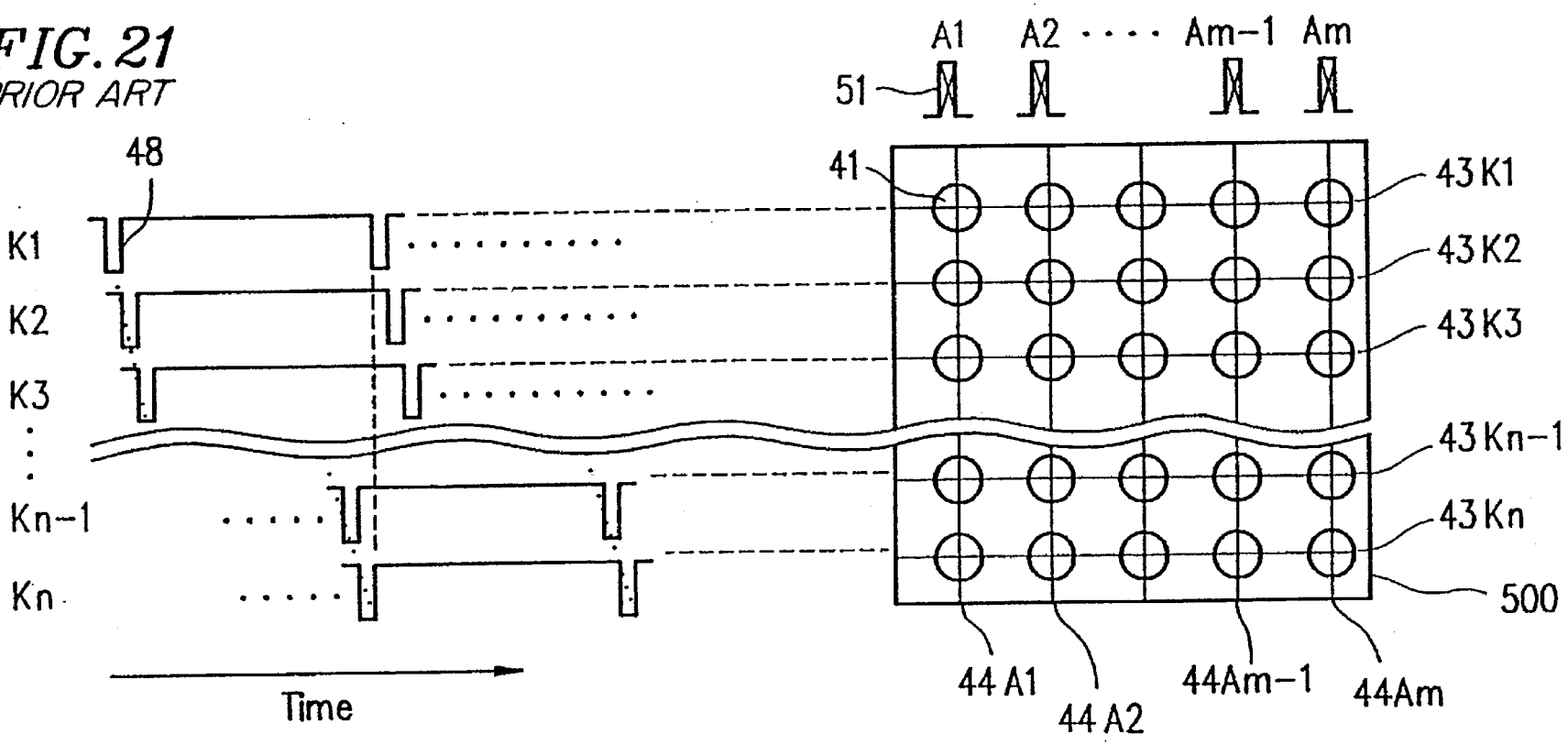
FIG. 21 PRIOR ART
FIG. 21 is a diagram showing a refresh driving method of the DC type PDP.
Figure 22:
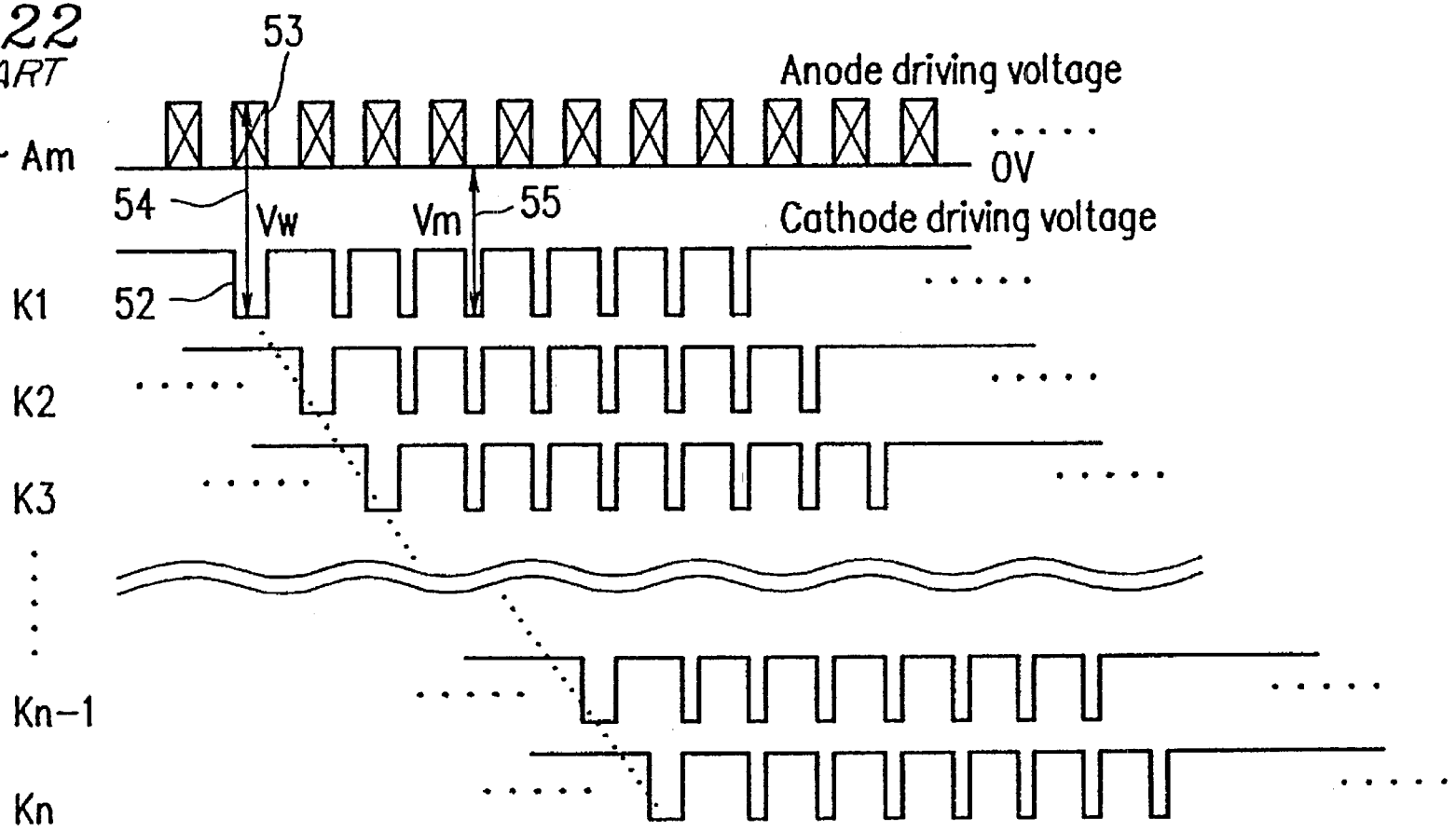
FIG. 22 PRIOR ART
FIG. 22 is a diagram showing a memory driving method of the DC type PDP.
Figure 23A:
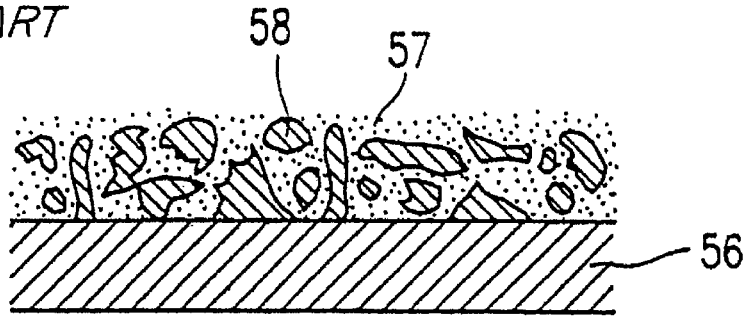
FIG. 23A PRIOR ART
FIG. 23A is a cross-sectional view showing the configuration of a cathode line formed by conventional spraying technique.
Figure 23B:
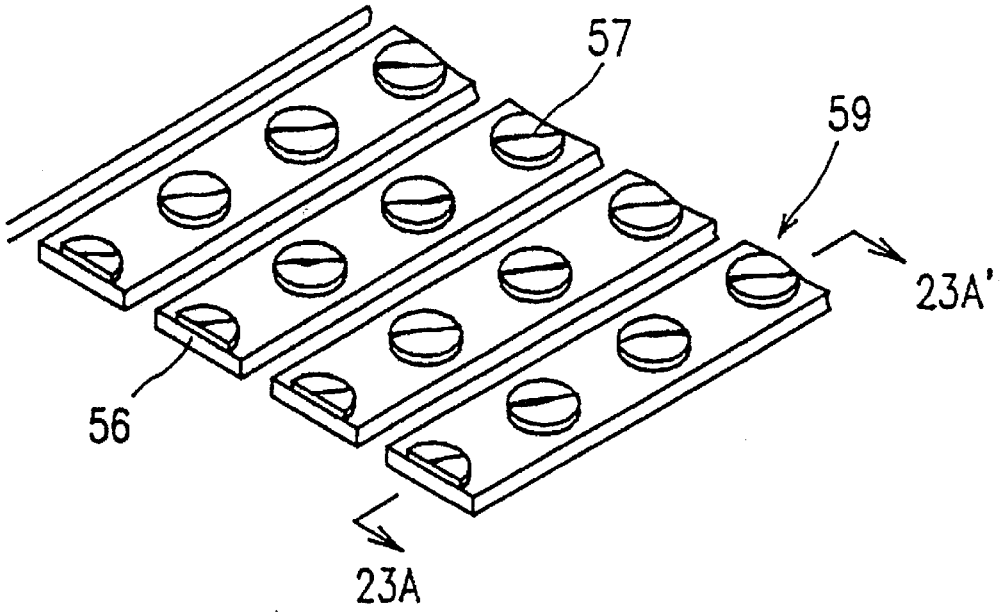
FIG. 23B PRIOR ART
FIG. 23B is a perspective view of the cathode line shown in FIG. 23A.
Figure 24:
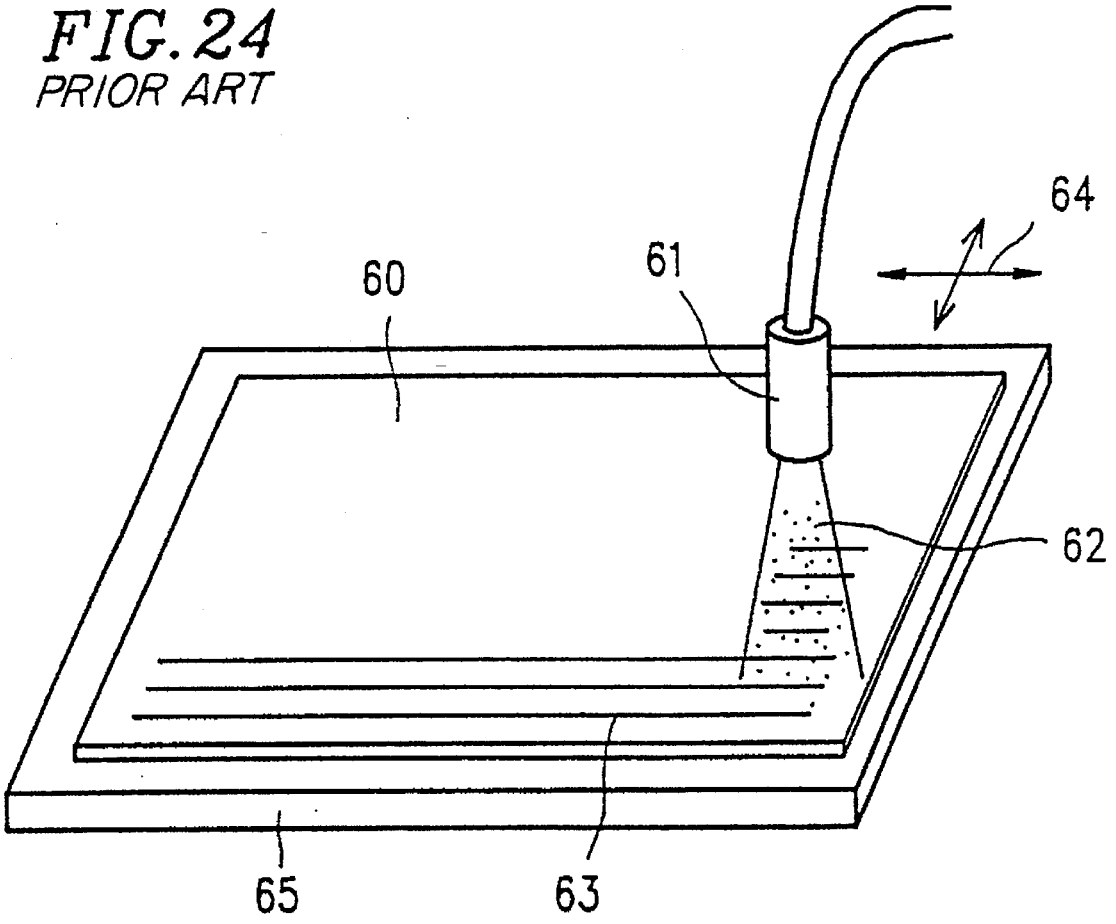
FIG. 24 PRIOR ART
FIG. 24 is a perspective view schematically showing the process of forming cathode lines on a glass substrate by a spraying method.

A terminal electrode for connection with an external circuit is further formed on the glass substrate 10, on which the cathode lines 13 are formed, by the screen printing method. A rear glass substrate formed in another process is then sealed against the glass substrate 10, thereby obtaining the structure shown in FIG. 20. After creating a vacuum in the gap between the substrates, a mixed gas of He-Xe functioning as a discharge gas is sealed to a predetermined pressure, thereby completing the DC type PDP.

Figure 3:
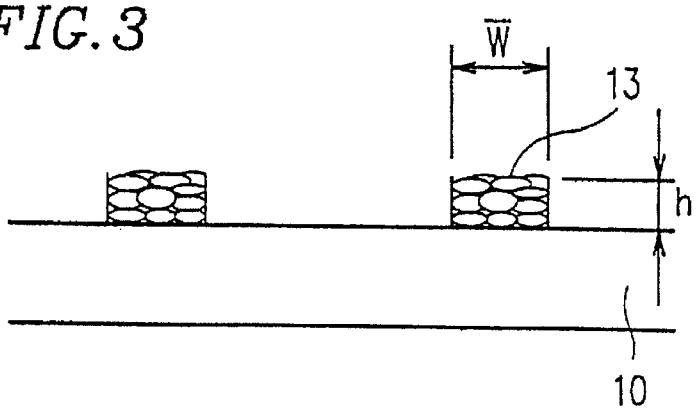
FIG. 3 is a schematic cross-sectional view showing the cathode line formed by Example 1 according to the present invention.

The cathode lines 13 thus formed have the laminated structure of particles as shown in FIG. 3. Specifically, the particles of the sprayed material 8, which collide in a melted state at a high speed against the surface of the glass substrate 10, are laminated while being flattened in a horizontal direction (a direction parallel to the surface of the glass substrate 10), thereby completing the cathode lines 13. A width W of the cathode lines 13 is typically 150 μm or less, for example, about 100 μm. A thickness h is typically in the range of 10 to 30 μm, for example, about 30 μm.

The surface of the glass substrate 10 is roughened by the sand blast processing in order to increase the adhesion between the cathode lines 13 to be formed and the glass substrate 10. If the adhesion is not sufficiently strong, the cathode lines 13 may be pealed off or disconnected by a mechanical load acting on the cathode lines 13 due to handling and the like during the fabrication process. As a result, the functions as the cathode lines 13 cannot be reserved in some cases. In particular, in the case where the film made of metal particles is formed on the glass substrate by spraying as in Example 1, difference in thermal expansion between the metal sprayed film (cathode lines) and the glass substrate is large, resulting in small adhesion.

The send blast processing may be substituted by the following process. Prior to spraying the cathode line material, an extremely thin film is formed by spraying a material exhibiting strong adhesion onto the glass substrate 10. Thereafter, a predetermined metal material may be sprayed thereon. As such a material capable of functioning as a so-called interlayer, for example, chromium oxide or a material obtained by mixing silica into chromium oxide is considered. Thus, excellent adhesion can be preserved.

Alternately, in the case where sufficient adhesion can be preserved, such a sand blast processing and a substitution thereof can be completely omitted.

Figure 4:
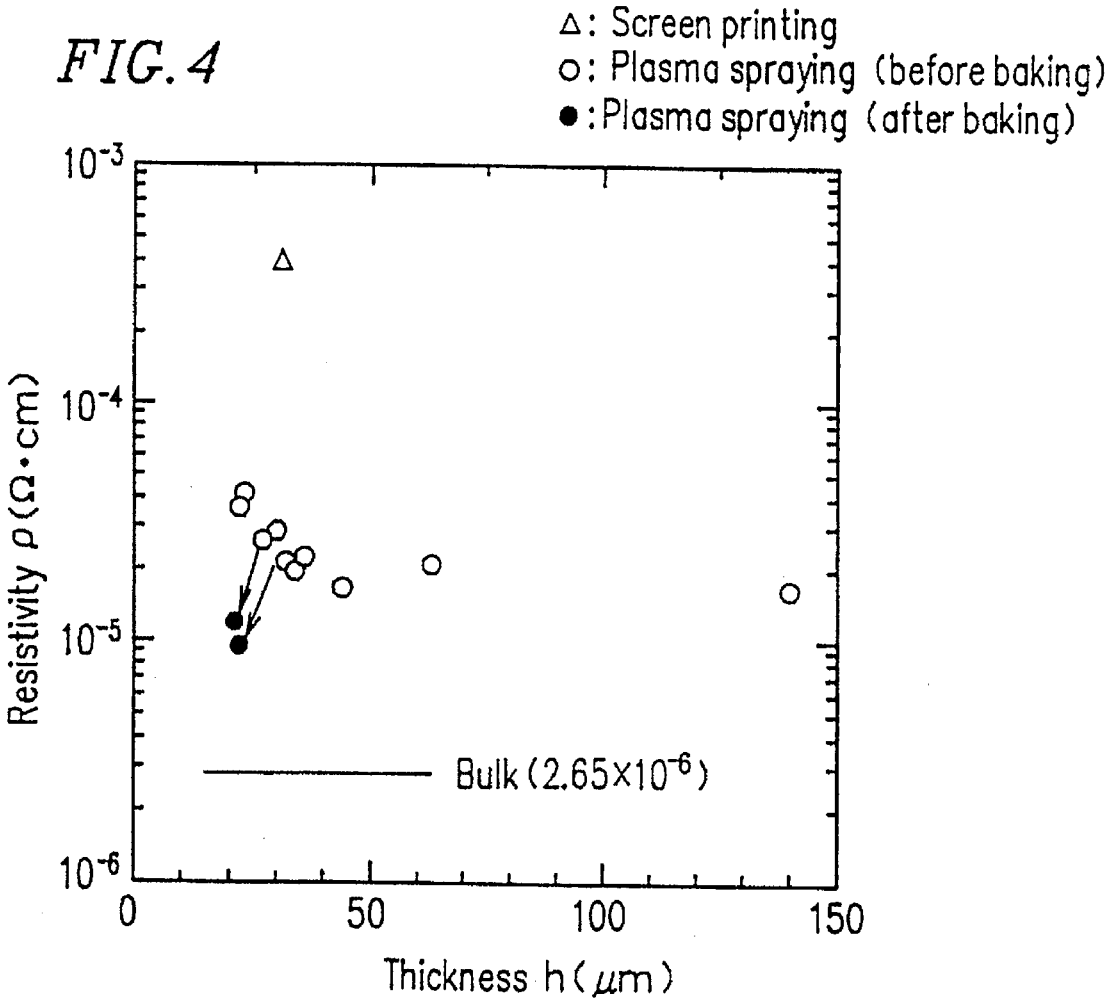
FIG. 4 is a graph showing the relationship between the thickness of the cathode line and the resistivity thereof.

FIG. 4 shows the relationship between a resistivity ρ and a thickness h of the cathode lines 13 formed by the plasma spraying method, where a width W of the cathode lines 13 is fixed to be 150 μm. A plot Δ indicates the value in the cathode lines formed by a conventional screen printing method, which is specifically $4.0\times10^{-6}$ Ω.cm. Each of plots ○ indicates a value in the stage where the cathode lines are formed by the plasma spraying method, and each of plots ● indicates a value after baking is conducted for forming the terminal electrode. The value of a bulk material of the metal aluminum ($2.65\times10^{-6}$ Ω.cm) is also shown in FIG. 4. With respect to the above respective values, the line resistance of the cathode line is measured, respectively. Resistivity values are then obtained by multiplying the measured values by a cross-sectional area of the cathode line (thickness×width) and subsequently dividing the multiplied values by the length.

As is apparent from FIG. 4, although the resistivity in the spraying method decreases as the thickness h increases, it becomes substantially constant at a certain thickness or more. Taking the cathode having a thickness of 30 μm as an example, the resistivity value obtained by spraying is low, i.e., about one-tenth as compared with that obtained by the screen printing method. The difference between the two results from the following. The component of the film formed by the spraying method is mainly a pure aluminum material, except for a small amount of oxide. On the other hand, in the screen printing method, impurities such as glass frit serving as a non-conductive material are inevitably mixed with the metal aluminum material. Therefore, the direct physical contact between aluminum metal particles is inhibited, leading to a lowered conductivity.

The reason why the resistivity decreases as the thickness h increases in the spraying method is regarded as an increase in the probability that particles to be laminated are physically in contact with each other. Although particles having a diameter of 20 μm are used as sprayed particles in the example shown in FIG. 4, the resistivity can be further reduced by using particles having a smaller diameter.

Even in the case where the cathode lines are formed by the plasma spraying method, if the metal aluminum is oxidized in the spraying step, the electrical resistivity of the cathode lines to be formed inevitably increases. In order to prevent the sprayed film from being oxidized, it is sufficient to reduce the pressure of a space (in which a film is formed) leading from the plasma spraying torch to the glass substrate which is subject to spraying during the spraying step.

Next, the effects of the baking process which is performed on the cathode lines formed by the plasma spraying process will be examined. Plots ○ in FIG. 4 respectively indicate a resistivity value obtained in the case where the cathode line formed by the plasma spraying is baked at 400° C. At this temperature, i.e. 400° C., the front glass substrate 39 on the cathode side and the rear glass substrate 40 on the anode side are sealed to each other by frit glass in the configuration shown in FIG. 20.

In the cathode lines formed by a plasma spraying method according to the present invention, the resistivity (plots ○) in the stage in which the baking process is not conducted is already about one-tenth of the value of the conventional cathode lines formed by screen printing. In addition, the resistivity after the baking process (plots ●) is further reduced by 30 to 50% as compared with the value before the baking process (plots ○). Simultaneously, the thickness is reduced by about 30%.

In order to examine the effects of the baking temperature level, the same measurement is performed on another sample which is subject to the similar baking process at a temperature of 580° C. The line resistance after baking the aluminum cathode is reduced to one-third of that before baking. The baking process is carried out in an atmosphere while rising a temperature from room temperature to 580° C. in an hour, keeping at 580° C. for 10 minutes, and lowering the temperature to room temperature again in an hour.

Regarding the sample baked at 580° C., the cross-section of the sprayed film (cathode line) before and after the baking process is observed with a scanning electron microscope (SEM). As a result, the sprayed film after the baking has a finer laminated structure as compared with that before the baking. It is considered that such a finer laminated structure is obtained because unmelted particles contained in the film immediately after the spraying or particles which are not laminated in the quenching process during the film deposition are melted at a temperature lower than their melting point, that is, a so-called melting point lowering phenomenon occurs.

Furthermore, with respect to the samples which are observed with the SEM, a change in the composition of the sprayed film before and after the baking process is analyzed by an X-ray micro analysis (XMA) method. As a result, the amount of oxygen contained in the sprayed film is slightly reduced after the baking. This signifies that part of aluminum which is oxidized immediately after the spraying is reduced by the baking process. However, the degree of change in the amount of oxygen contained is not large enough to afford a large decrease in the resistivity of the cathode lines. Thus, the resistivity of the cathode lines is considered to be lowered not by reduction of aluminum oxide but mainly by finer quality of sprayed film resulting from baking.

The cathode lines formed by the screen printing method are subject to a similar baking process and a change in the resistivity before and after the process is measured. However, the resistivity of the aluminum cathode lines formed by the screen printing method increases in some cases rather than decreases, after the baking process. Thus, the resistivity thereof is unstable. As described above, the decrease in the resistivity due to the baking process is unique to the cathode lines formed by spraying.

From the above result, it is understood that the resistivity of the cathode line formed by the plasma spraying method is one-tenth of the resistivity of the cathode lines formed by the screen printing method, and can be further reduced to a half thereof or less by the baking process at 400° C. or higher in an atmosphere.

Figure 5:
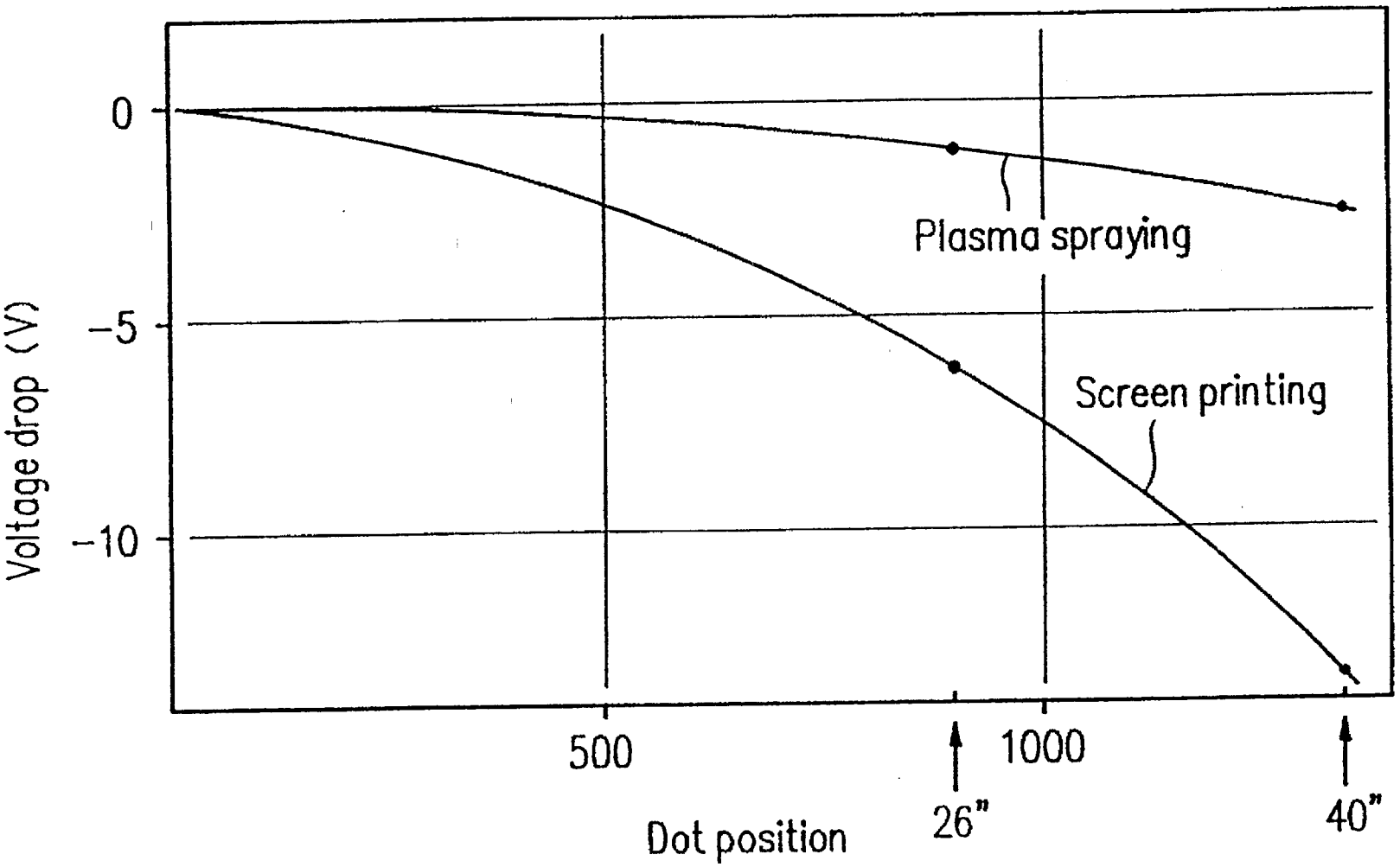
FIG. 5 is a graph showing a voltage drop in a cathode line in a memory driving method.

FIG. 5 shows voltage drops of the cathode lines formed by screen printing and plasma spraying, respectively, in the memory driving method. The dot position (the number of dots) represented by an abscissa corresponds to a size of a screen of the PDP (a length of a cathode line). For example, the number of dots corresponding to a wide television of a 26 inch size is about 900, and that corresponding to a television of 40 inch size is about 1400. The data in FIG. 5 is obtained by calculation under condition that a discharge current in each of the discharge cells is 60 μA.

The voltage drops shown in FIG. 5 directly represent difference in resistivities of the respective cathode lines. For example, in a 26 inch size television, a voltage drop of 5 V occurs in the cathode fabricated by screen printing. Such a large voltage drop brings about disadvantages such as an extremely wide difference in luminance between the both ends of the screen, decrease in the memory margin, unlighting pixels and the like, which result in deterioration of the quality of the display image. On the other hand, in the cathode fabricated by the plasma spraying method, the voltage drop is small, i.e., about 1 V even in the 26 inch size television. The effect of the voltage drop to such a degree can be sufficiently compensated by the functions of other components. Thus, the same problems as in the screen printing do not occur, and an extremely excellent image can be provided. In the above description, a phenomenon for one cathode line at a certain moment during a driving time period is paid attention to.

The data shown in FIG. 5 indicates the result obtained in the case where a driving circuit is provided on one side of the PDP. If driving circuits are provided on both sides of the PDP, a voltage drop in the cathode lines is reduced to, at maximum, a half or less of the data shown in FIG. 5. In consideration of fabrication cost, circuit size and the like, a method for forming the driving circuits on the both sides of the PDP is hardly realizable.

Next, a variation in the driving voltage in the case where the PDP is lightened over a long lightening time period is examined as a long-term life test. The long lightening time period in this case signifies about 30 thousand hours which are generally required as a life of a television for domestic use.

Figure 6:
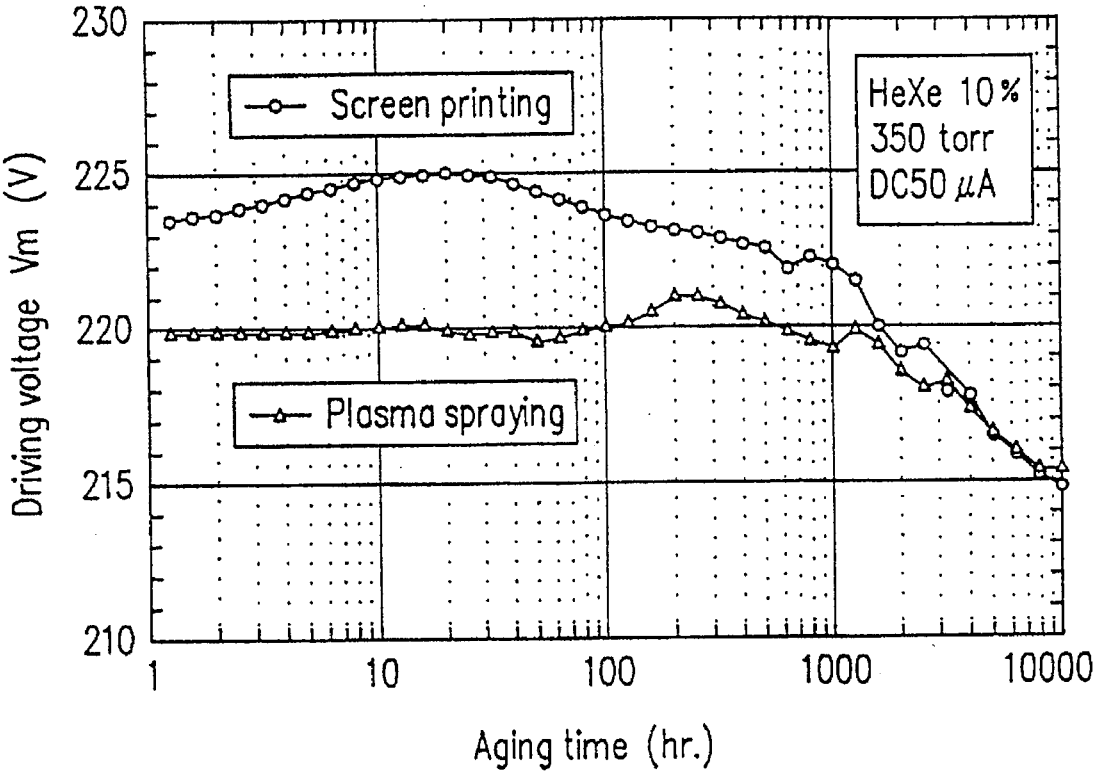
FIG. 6 is a graph showing the variation in a driving voltage during a long lightening (aging) time period in the memory driving method.

FIG. 6 shows the variation in the driving voltage in the case where the DC type PDP is lightened for a long time by the memory driving method. In one PDP, cathode lines in the same panel are separately formed by the screen printing and the plasma spraying. Then, the variation in the driving voltage is measured with respect to each of the cathode lines. Data in FIG. 5 are measured in a DC type PDP in which discharge cells having a size of about 300 μm×about 300 μm and a discharge gap of 200 μm of are provided with Me–Xe10% gas as a discharge gas sealed at a gas pressure of 350 Torr. Specifically, DC discharges continuously occur with a discharge current of 50 μA for each of the discharge cells. Plots in FIG. 6 respectively show average values of the driving voltage for ten pixels dots.

Generally, as the lightening time period elapses, the cathode lines are sputtered by a discharge to be scattered. The scattered particles of the cathode lines attach to the surface of the glass substrate in the periphery of the cathode lines. As a result, in some cases, the cathode area involving the discharge substantially increases, thereby varying the driving voltage. When the data shown in FIG. 6 is measured, in order to prevent the discharge area from expanding due to sputtering, a groove pattern is formed on the surface of the glass substrate, and a film made of cathode material is formed on the bottom face of the groove by the screen printing or the plasma spraying, thereby completing the cathode lines.

It can be seen from FIG. 6 that, at the time when ten thousand hours elapse from the start of the measurement, the driving voltage is lowered by about 10 V in the cathode line formed by the screen printing. On the other hand, the driving voltage is lowered by about 5 V, that is, a half of the value of the screen printing, in the cathode line formed by the plasma spraying. As the result of continuation of the similar measurement, at the time when 30 thousand hours elapse, the driving voltage of the cathode lines formed by the plasma spraying is lowered by about 8 V, while the driving voltage of the cathode line formed by the screen printing is lowered by about 15 V.

As described above, when the cathode lines are formed by screen printing, it is difficult to drive the PDP in the memory driving method due to the decrease in driving voltage attending the driving for long time. As a result, the function of the PDP as an image display device can be reserved up to about 10 thousand hours at most. On the other hand, when the cathode lines are formed by the plasma spraying method as in the present invention, a high-quality image display can be stably realized while sufficiently reserving the memory margin, in either of the refresh driving method and the memory driving method. These advantages are particularly conspicuous in the latter memory driving method.

In the above description of Example 1, the cathode lines are made of metal aluminum since the metal aluminum is excellent as a cathode line material. This is because metal aluminum is hardly sputtered with respect to the He-Xe mixed gas which is suitable as a discharge gas for realizing a full-color image display.

In the case where a material having a low specific weight and a low melting point such as aluminum is used as a material to be sprayed for forming the cathode lines, as shown in FIG. 1, the structure of the plasma spraying device 100 using a so-called extrapolation mode, in which a spraying powder is blown into the plasma jet 6 after the jetting out thereof, is suitable for forming the cathode lines having excellent properties. In the case where finer particles having a lower specific weight are used, the sprayed material is not sufficiently blown into the plasma jet 6 in some cases. In such cases, there arise problems such as adhesion of the sprayed material in an unmelted state to the surface of the substrate 10 or a decrease in the spraying efficiency.

In order to solve the above problems, it is sufficient to use fine particles which are processed in advance so as to have an appropriate shape. FIGS. 7A and 7B show an example of the change of the particle shape in such a processing process.

Primary particles 16 having an average diameter of d as shown in FIG. 7A are bonded to each other using polyvinyl alcohol (PVA) or the like, thereby forming processed particles 17 each being a set of a plurality of primary particles 16. As shown in FIG. 7B, each of the processed particles 17 has an average diameter of D (D>d). According to the inventors' experiments, in the case where a 40 kW class plasma spraying apparatus is used, the spraying particles are uniformly blown into the plasma jet 6 by processing the primary particles 16 so that the average diameter D of the processed particles 17 is 30 μm or more regardless of the average diameter d of the primary particles 16, thereby completing a sprayed film (cathode lines) of good quality. Thus, extremely fine primary particles are also applicable.

Paying attention to the process in which each of the sprayed particles is flattened after colliding against the substrate 10, in order to obtain a sufficiently fine sprayed film (cathode lines) having sufficiently strong adherence to the glass substrate 10, it is desirable that the particles being attached to the substrate 10 are flattened so that the diameter of the particles is three times the average diameter d of the primary particles 16. Furthermore, in order to obtain a fine sprayed film capable of reserving the sufficient adherence to the substrate 10 and reducing the electrical resistivity to the lowest level when the primary particles are flattened as described above so that a sprayed material is adhered to the surface of the glass substrate 10 in such a state that the diameter thereof is about three times the average diameter d of the primary particles 16, it is desirable that the flattened particles are laminated to three layers or more in a thickness direction of the cathode line, or three flattened particles or more are adhered in a width direction of the cathode line. In the case where the sprayed particles in the sprayed film (cathode lines) are present in such a state, a fine sprayed film (cathode lines) which is most suitable in terms of adherence to the glass substrate and the electrical resistance is formed.

If the average diameter d of the primary particles 16 and the spraying conditions are selected so as to attain the above conditions, a sprayed film, which demonstrates sufficiently good characteristics while being made to function as the cathode lines of the PDP, is formed. Specifically, supposing the formation of cathode lines having a width of W and a thickness of h, by using the spraying powders obtained from the primary particles 16 having an average diameter d which is set in the range, the upper limit thereof being a smaller one of h/2 and W/9 and the lower limit thereof being 10 μm, the cathode lines having a high quality can be formed. A value of 10 μm, which is the lower limit of the average diameter d, is determined, as a minimum value required for efficiently carrying the spraying powder materials in the supply port 9.

EXAMPLE 2

With reference to FIGS. 8A to 8C, Example 2 of the present invention will be described.

The cathode lines 13 formed on the surface of the glass substrate 10 by plasma spraying have, as shown in FIG. 8A, rougher surfaces 13*a* as compared with those obtained by screen printing. Therefore, the discharge may concentrate on protrusions of the surfaces 13*a* of the cathode lines 13, thereby eroding a certain portion of the cathode lines 13.

Thus, in Example 2, in order to eliminate unevenness of the surfaces of the cathode lines 13 formed by plasma spraying, the glass substrate 10 on which the cathode lines 13 are formed is etched by being immersed into an etchant 19 as shown in FIG. 8B. Specifically, the etching is conducted by immersing the glass substrate 10 into the etchant 19 which is a 1.0% sodium hydroxide solution for 15 minutes. Thereafter, the glass substrate 10 taken out of the etchant is washed in flowing water for 10 minutes.

By such an etching process, smoothed surfaces 13*b* are provided for the cathode lines 13 as shown in FIG. 8C. Specifically, while an average surface roughness Ra of the surfaces 13*a* formed by plasma spraying is about 4, that of the surfaces 13*b* after being subject to the etching process is reduced to about 2. With such a reduced average surface roughness, the discharge is prevented from concentrating on the surfaces of the cathode lines 13. As a result, the discharge voltage of the PDP can be stabilized over a long-term period.

The surfaces of the cathode lines 13 can be flattened not only by etching utilizing the solution as described above but also by a mechanical process such as grinding.

EXAMPLE 3

Figure 9:
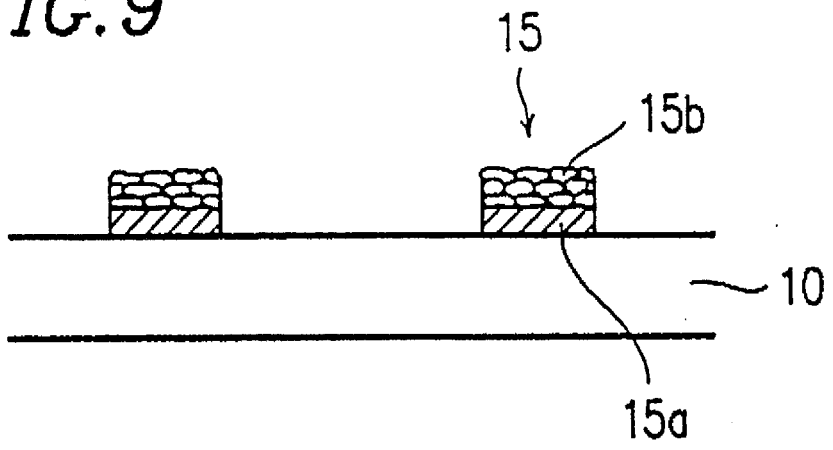
FIG. 9 is a schematic cross-sectional view of a cathode line formed by Example 3 of the present invention.

With reference to FIG. 9, a third example of the present invention will be described.

In the preceding examples, the cathode lines 13 are formed of pure metal (aluminum). When discharge occurs in the cathode lines made of pure metal, there arise problems such as a high discharge voltage, a large sputtering rate and the generation of discharge contraction, although it depends on some conditions such as the kind of discharge gas to be used, the pressure thereof and the configuration of the electrodes.

In order to inhibit the discharge contraction, it is sufficient to constitute the cathode lines by a material of a small sputtering rate, for example, a dielectric material. However, since the dielectric is an insulating material, the cathode lines cannot be formed of dielectric material alone.

Thus, in Example 3, an upper coating 15*b* made of dielectric material is formed on bus lines 15*a* made of aluminum which is a low resistive metal, thereby constituting cathode lines 15 having a double-layered structure.

Specifically, the bus lines 15*a* made of aluminum is first formed by spraying a powder of metal aluminum onto the glass substrate 10 by plasma spraying. At this time, the thickness of the bus line 15*a* is typically in the range of 30 to 40 μm. Next, the upper coating 15*b* made of a mixture of metal aluminum and dielectric is laminated onto the bus lines 15*a* by a spraying method or another method. Finally, the glass substrate 10 is baked at 400° C. or more, thereby forming the cathode lines 15. Although only one upper coating 15*b* is formed in FIG. 9, the cathode lines 15 may include more than one laminated coatings.

As described above, the resistivity of cathode lines 15 can be reduced by forming at least bus lines 15*a* of the cathode lines 15 by plasma spraying. The material to be used for plasma spraying is not particularly limited to a particular material.

In the case where the upper coating 15*b* is formed by plasma spraying, for example, an alumina powder including particles having an average diameter of 7 μm can be used for spraying in Example 3. Alternatively, the upper coating 15b made of perovskite type oxide, whose structure is represented by $La_{1-x}Sr_xMO_3$ (where M is Co or Mn) may be formed on the surfaces of the bus lines 15a by a spraying method or another method. Even in these cases, when at least bus lines 15a are formed by plasma spraying, the cathode lines 15 containing only a small amount of impurity can be formed.

By forming the cathode lines having a multi-layered structure as in Example 3, the resistivity of the cathode lines can be reduced while the discharge contraction can be inhibited. As a result, cathode lines having more excellent characteristics are formed. Thus, a discharge voltage of the PDP can be stabilized over a long time period.

EXAMPLE 4

Figure 10:
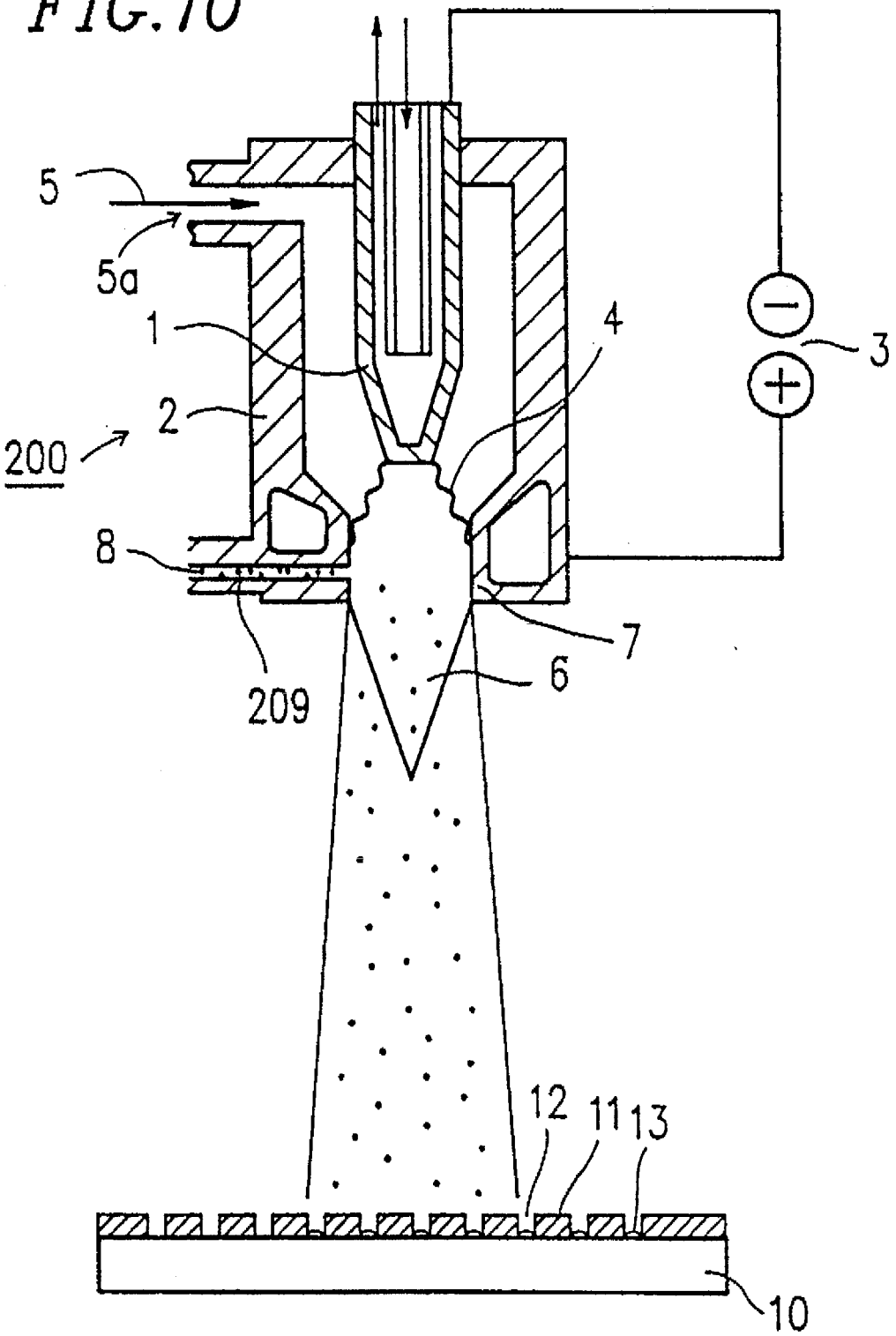
FIG. 10 schematically shows a method for fabricating a cathode line of a DC type PDP in Example 4 according to the present invention.

With reference to FIG. 10, Example 4 of the present invention will be described.

FIG. 10 schematically shows the formation of cathode lines of a PDP by plasma spraying in Example 4 according to the present invention. A plasma spraying torch 200 used in Example 4 has basically the same configuration and functions as those of the plasma spraying torch 100 in Example 1 of FIG. 1. In FIGS. 1 and 10, since like components are denoted by like reference numerals, and therefore the detailed description thereof is herein omitted.

The plasma spraying torch 200 differs from the plasma spraying torch 100 of Example 1 in that a supply port 209 of the powder of the material 8 to be sprayed is placed perpendicularly to the inner wall of the nozzle 7 so that the spraying material 8 is perpendicularly and directly supplied to the plasma jet 6 inside the nozzle 7. Specifically, the plasma spraying torch 200 has the interpolation type structure.

The interpolation type plasma spraying torch 200 has an advantage that the spraying material is melted without fail as compared with the extrapolation type plasma spraying torch 100 in which the powder of the spraying material 8 is blown into the plasma jet 6 outside the nozzle. However, if the diameter of the supply port 209 is too small or the flow rate of carrier gas is insufficient, the powder of spraying material 8 is melted inside the supply port 209 so as to adhere to the inner wall thereof. In such a case, operational efficiency is lowered, and the quality of film of the cathode lines (sprayed film) 13 is deteriorated due to lumps of the adhered spraying material falling out so as to be supplied onto the glass substrate 10. Therefore, the diameter of supply port 209 of the spraying material 8 and the flow rate of carrier gas are required to be optimized so as to prevent such disadvantages.

Moreover, in the structure of FIG. 10, the supply port 209 of the spraying material 8 is only unidirectionally provided. On the other hand, if a plurality of supply ports are provided in the periphery of the nozzle 7 at equal angular intervals, the distribution of the plasma jet 6 and a mixing condition of the spraying material therewith are uniformed, thereby forming the cathode lines (sprayed film) 13 of a more excellent quality.

EXAMPLE 5

Figure 11:
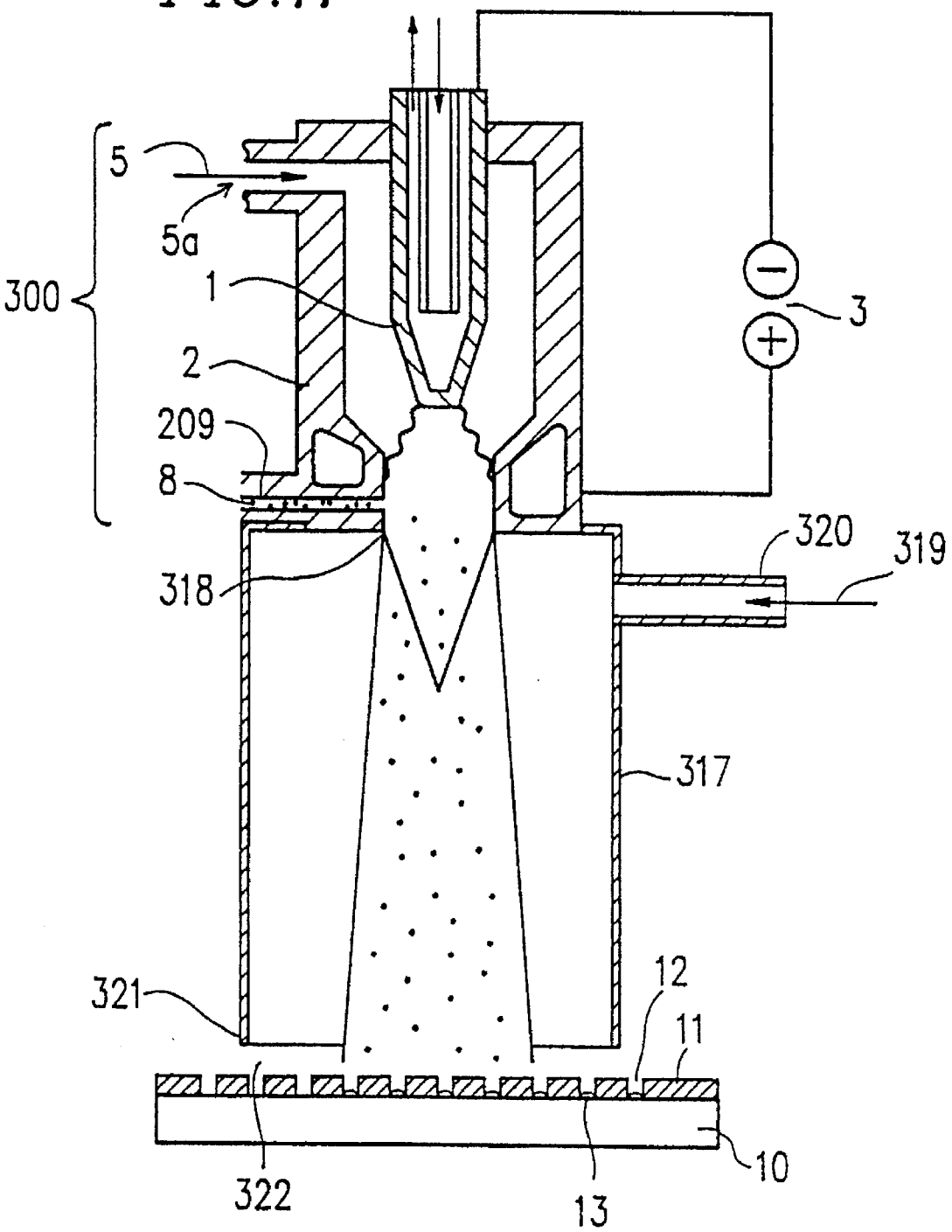
FIG. 11 schematically shows a method for fabricating a cathode line of a CD type PDP in Example 5 according to the present invention.

With reference to FIG. 11, Example 5 of the present invention will be described.

FIG. 11 schematically shows the formation of cathode lines of a PDP by plasma spraying in Example 5 according to the present invention. A plasma spraying torch 300 used in Example 5 has basically the same configuration and functions as those of the plasma spraying torch 200 in Example 2 of FIG. 10. In FIGS. 10 and 11, like components are denoted by like reference numerals, and therefore the detailed description thereof is herein omitted.

The plasma spraying torch 300 of Example 5 differs from the plasma spraying torch 200 of Example 2 in that a casing 317 for controlling the atmosphere is provided below the plasma spraying torch 300. The casing 317 is provided so as to enclose a space from a lower part of a nozzle outlet 318 of the plasma spraying torch 300 to the vicinity of the upper surface of the glass substrate 10 on which a material is sprayed.

Furthermore, inside the casing 317, an inert gas 319 is lead from an introducing port 320. As the inert gas 319, argon, helium or the like can be used. Alternatively, instead of the inert gas, a reducing gas, for example, gaseous hydrogen and the like may be introduced.

A space 322 is provided between the upper surface of the glass substrate 10 and a lower end 321 of the casing 317. A gas of the plasma jet 6, the inert gas 319 introduced, and particles which do not adhere to the glass substrate 10 among the sprayed particles 8 are exhausted outside via the space 322.

In the case where spraying is performed in a plasma spraying torch without the casing 317, for example, aluminum is sprayed onto the glass substrate 10 in an atmosphere, the formed sprayed film (cathode lines) 13 is oxidized by oxygen in the atmosphere, which is taken in the plasma jet 6 in the vicinity of the upper surface of the glass substrate 10. On the other hand, in the plasma spraying torch 300 in Example 5, since the periphery of the plasma jet 6 is enclosed by the casing 317 and the inert gas 319 or the reducing gas is introduced thereto, the sprayed film is not oxidized. Thus, an electrical resistivity is prevented from increasing due to the oxide entering the cathode lines, thereby forming cathode lines having more excellent characteristics.

EXAMPLE 6

FIGS. 12A to 12F show another process of forming the cathode lines on the front glass substrate according to the present invention.

Figure 12A:
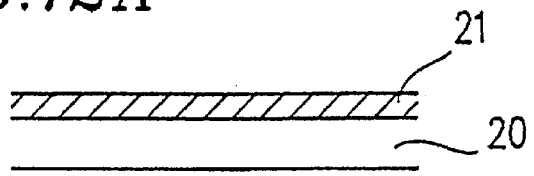
FIGS. 12A to 12F are cross-sectional views showing the respective fabrication steps of cathode lines in a DC type PDP in Example 6 according to the present invention.
Figure 12B:
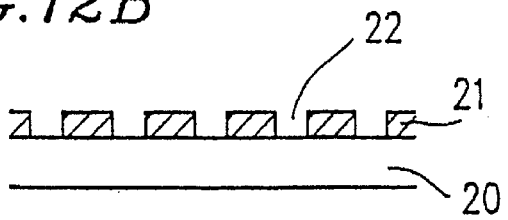

First, as shown in FIG. 12A, a mask film 21 is attached onto the surface of the glass substrate 20. As the mask film 21, for example, a dry film which is commercially available from TOKYO OHKA KOGYO, Co., Ltd. under the general trade designation "BF series" can be used. Next, as shown in FIG. 12B, openings 22 are formed into a pattern corresponding to a cathode line pattern to be formed on the mask film 21 by an exposing process and an etching process.

Figure 12C:
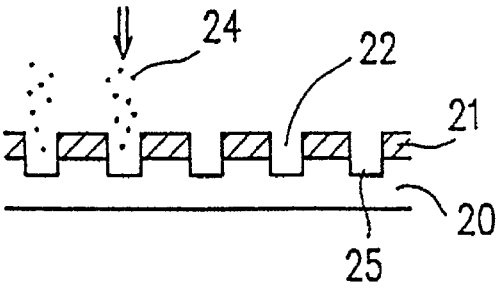
Figure 12D:
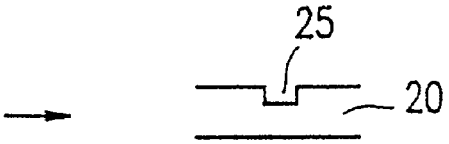

Furthermore, as shown in FIG. 12C, blast particles 24 are made to collide against the upper surface of the glass substrate 20 through the mask film 21 on which the openings 22 are formed, thereby conducting a sand blast processing. By this sand blast processing, as shown in FIG. 12D, grooves 25 are formed at the positions corresponding to the openings 22 in the surface of the glass substrate 20. The sand blast processing forms the grooves 25 as well as roughens the bottom face of the grooves 25. A preferable degree of the roughening changes depending on the sprayed material, spraying conditions and the like. Typically, it is desirable that a roughened surface whose center line average roughness Ra is about 1. As previously described in connection with the first example, the adherence between the cathode lines to be formed and the glass substrate can be increased by roughening the surface of the glass substrate.

Figure 12E:
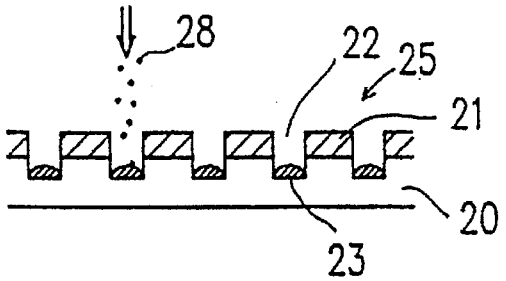
Figure 12F:
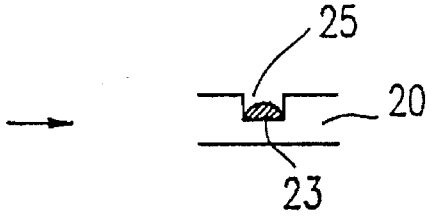

Next, as shown in FIG. 12E, the spraying material 28 is made to collide against the surface of the glass substrate 20 by plasma spraying through the openings 22 provided though the mask film 21, thereby forming a film made of a cathode line material. As a result, a sprayed film, that is, cathode lines 23, having strong adherence is formed on the bottom faces of the grooves 25 of the glass substrate 20 corresponding to the openings 22. On the other hand, the sprayed particles which reach the surface of the mask film 21 recoil due to the elasticity of the mask film 21. Therefore, the sprayed film 23 is not deposited onto the surface of the glass substrate 20 other than the portions corresponding to the openings 22. The mask film 21 is pealed off after completion of the spraying process, and then the cathode lines 23 formed only on the bottom faces of the grooves 25 of the substrate 20 are obtained, as shown in FIG. 12F.

As previously described in Example 1, when the PDP is continuously operated over a long lightening time period, for example, about 30 thousand hours, the driving voltage is greatly lowered in the cathode lines formed by conventional screen printing. The increase in the discharge area due to sputtering of the cathode line material is considered as one of the causes of deterioration with aging. On the other hand, if the cathode lines 23 are formed inside the grooves 25 as in Example 6, the increase in the discharge area due to sputtering is inhibited. Therefore, variation in the discharge voltage can be inhibited.

Figure 13A:
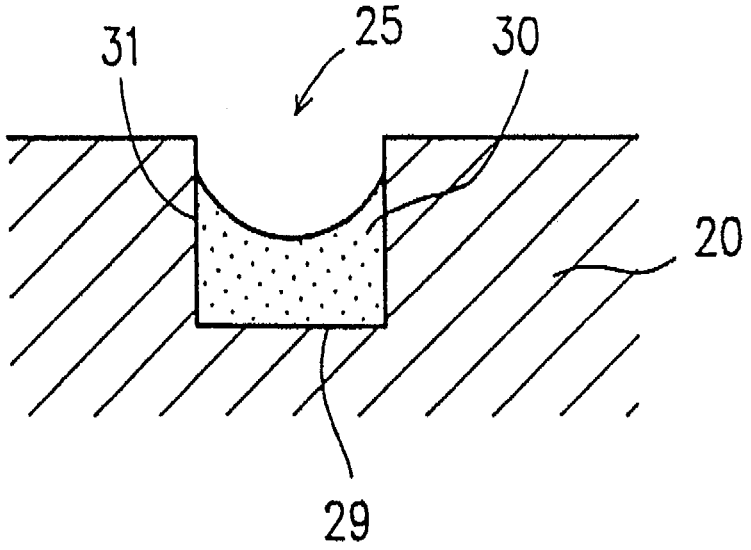
FIG. 13A is a cross-sectional view schematically showing a cathode line formed in a groove in the conventional screen printing.

However, if the cathode lines are formed inside such grooves 25 by conventional screen printing, the grooves 25 are filled with the cathode material 30 up to the level close to the surface of the substrate 20 in the vicinity of side walls 31 of the grooves 25 as shown in FIG. 13A. Therefore, the cathode line material 30 is scattered outside the grooves 25 by sputtering accompanying the discharge, and the above-mentioned effects are not sufficiently demonstrated.

Figure 13B:
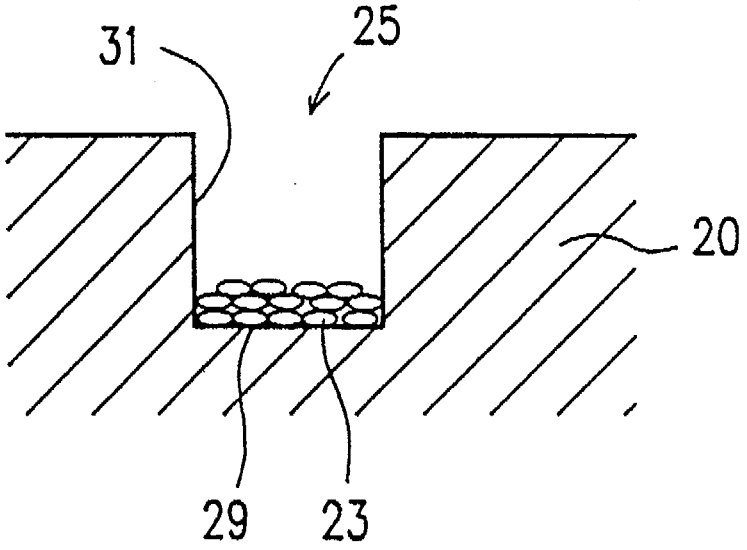
FIG. 13B is a cross-sectional view schematically showing the cathode line formed in a groove by Example 6 according to the present invention.

On the other hand, the sprayed film 23 is formed only on the bottom 29 of the grooves 25 by the plasma spraying method as shown in FIG. 13B. This is because the film formed by spraying utilizes linearly moving particles to be deposited in principle so that the sprayed particles are prevented from adhering to the side walls 31 of the grooves 25.

Figure 14:
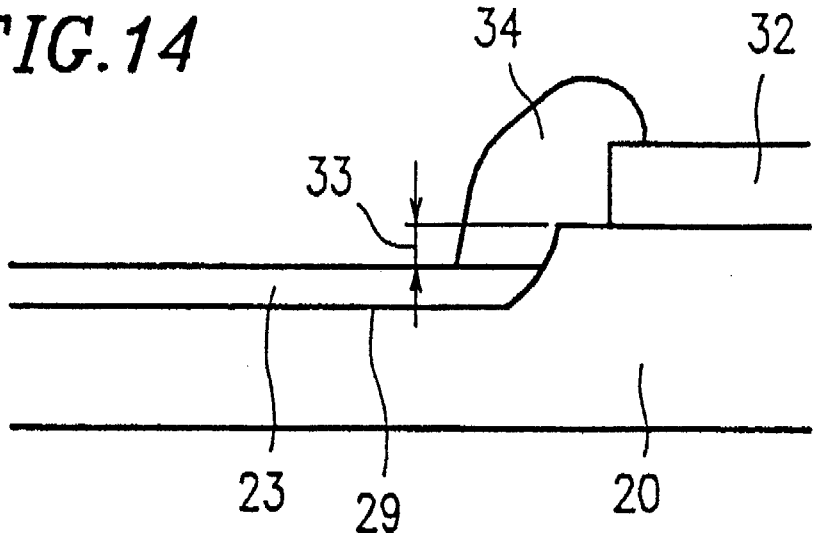
FIG. 14 is a cross-sectional view schematically showing the shape of a terminal electrode attaching to the cathode line formed by Example 6 according to the present invention.

FIG. 14 is a cross-sectional view schematically showing the structure of the glass substrate 20, on which the cathode lines 23 are formed in accordance with Example 6, in the vicinity of a terminal electrode 32.

Since the cathode line 23 is formed on the bottom 29 of the groove 25, there is a difference in level 33 between the terminal electrode 32 and the cathode line 23 on the glass substrate 20. Therefore, an electrical connection between the two may not be accomplished.

In order to electrically connect the terminal electrode 32 and the cathode line 23, a conductive paste material 34 is molded in the region having the difference in level 33 after the spraying process. As the conductive paste material 34, for example, a nickel paste can be used. After molding the conductive paste material 34, a baking process is carried out at 580° C., thereby making the molded conductive paste material 34 function as a connection line for connecting the cathode line 23 and the terminal electrode 32. The baking process is conducted so as to improve the characteristics of the spraying film (cathode lines) 23 as described in Example 1 as well as bake the conductive paste material 34. Therefore, this process contributes to the improvement of the resistivity value of the cathode line.

Table 1 shows values of voltage drop in a cathode line being continuously lightened for 30 thousand hours in the plane structure, in which the cathode lines are formed on the surface of the glass substrate, and in the groove structure, in which the cathode lines are formed on the bottoms of the grooves, respectively. Moreover, Table 1 shows values in the case where the cathode lines are formed by plasma spraying and in the case where the cathode lines are formed by screen printing in the respective structures described above. The data is Table 1 is measured in a DC type PDP in which discharge cells having a size of about 300 μm×about 300 μm and a discharge gap of 200 μm of are provided with He - Xe10% gas as a discharge gas sealed at a gas pressure of 350 Torr. Specifically, DC discharges continuously occur with a discharge current of 50 μA for each of the discharge cells.

As can be seen from Table 1, the degree of voltage drop of the groove structure is small as compared with that of the plane structure in both cases where the cathode lines are formed by screen printing and by plasma spraying. Furthermore, in the case where the cathode lines of the groove structure is formed by plasma spraying, the minimum value of voltage drop can be obtained. Therefore, in such a case, the deterioration of the driving voltage with aging can be excellently inhibited.

TABLE 1

| | Plane structure | Groove structure |
|---|---|---|
| Screen printing | 20 (V) | 15 (V) |
| plasma spraying | 10 (V) | 7 (V) |

EXAMPLE 7

With reference to FIGS. 15 to 19, a fabrication process of the cathode line by plasma spraying in the present invention will be further described as a seventh example of the present invention.

Figure 15:
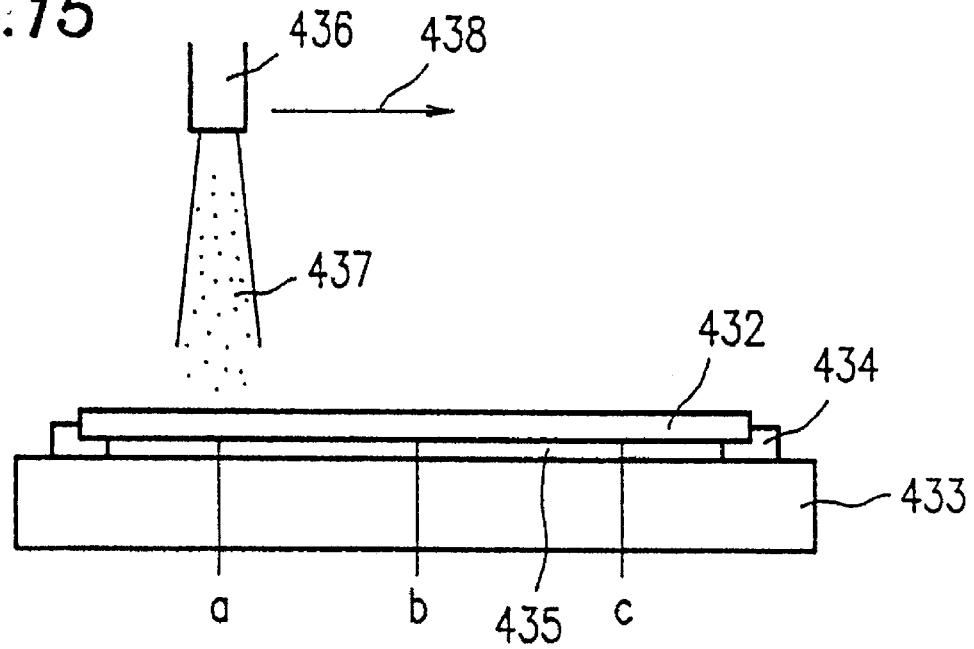
FIG. 15 schematically shows a fabrication process for forming cathode lines on a glass substrate by plasma spraying according to the present invention.

FIG. 15 schematically shows the fabrication process for forming the cathode line on a glass substrate 432 by plasma spraying according to the present invention. Specifically, in FIG. 15, the rectangular glass substrate 423 (fundamentally corresponding to a wide screen) which is subject to the plasma spraying is viewed from the direction perpendicular to the cathode lines to be formed, that is, a latitudinal direction of the glass substrate 432.

The glass substrate 432 is mounted on a mounting table 433 made of metal and the like via a jig 434. An air layer 435 having a thickness of about 1 mm is provided between the mounting table 433 and the glass substrate 432. A plasma spraying torch 436, from which a plasma jet 437 including spraying particles is provided so as to collide against the glass substrate 432, is placed above the glass substrate 432.

Since the glass substrate 432 is generally large in size, the plasma spraying torch 436 is moved at a predetermined speed in accordance with a predetermined pattern so that the entire upper surface of the glass substrate 432 is subject to spraying with the plasma jet 437, thereby forming the sprayed film, that is, the cathode lines on the entire surface. In the configuration shown in FIG. 15, a number of cathode lines are formed in a direction vertical to FIG. 15. Therefore, the plasma spraying torch 436 is moved in the direction perpendicular to the figure, thereby forming a cathode line for one line. Next, the plasma spraying torch 436 is moved by a predetermined pitch in a direction indicated by an arrow 438 of FIG. 15 so as to form a next cathode line with the similar spraying. By repeating these steps, a sprayed film is formed over the entire surface of the glass substrate 432.

Alternatively, the glass substrate 432 (or the mounting table 433) may be moved instead of the plasma spraying torch 436 so as to realize the movement of the relatively same pattern as described above.

Figure 17:
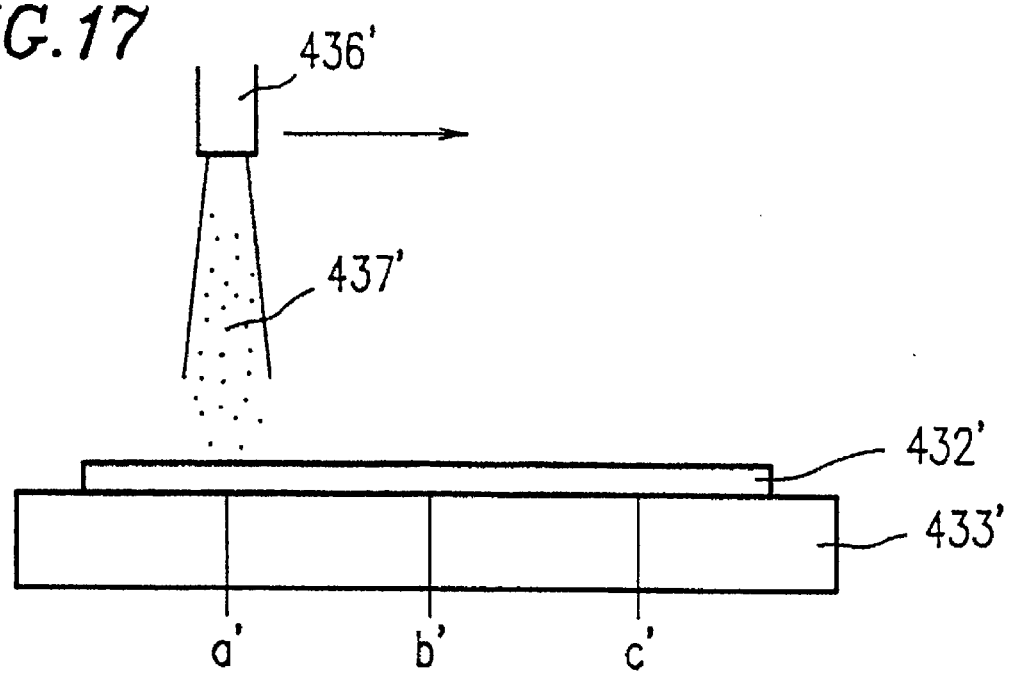
FIG. 17 schematically shows a fabrication process for forming cathode lines on a glass substrate by conventional plasma spraying.

For comparison, an example of the spraying process in a conventional method will be described with reference to FIGS. 17 and 18. FIG. 17 shows a rectangular glass substrate 432' (fundamentally corresponding to a wide screen) to be subject to spraying, which is viewed from the direction perpendicular to the cathode lines to be formed, that is, a latitudinal direction of the glass substrate 432'. In a conventional method, the glass substrate 432' which is subject to spraying is directly placed on a mounting table 433' made of metal because a heat load applied to the glass substrate 432' by the plasma jet 437' which is jet out of the plasma spraying torch 436' should be released to the mounting table 433' as soon as possible.

Figure 18:
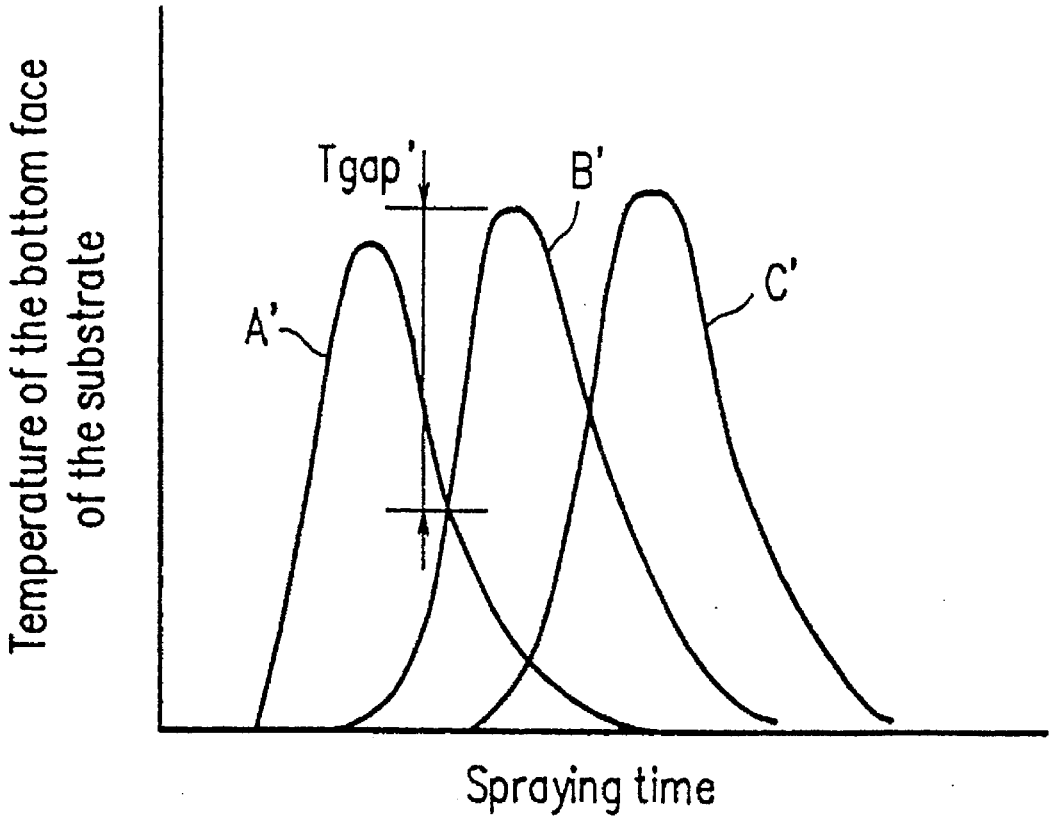
FIG. 18 is a graph showing the change in substrate temperatures in the conventional plasma spraying process shown in FIG. 17.

FIG. 18 is a graph showing temperature variations in the bottom surface of the glass substrate 432' at points a', b' and c' in FIG. 17, respectively. An ordinate corresponds to time in which the spraying has been proceeded, and an abscissa represents a temperature for each point. Specifically, curves A', B', and C' of FIG. 18 show temperature variations at the points a', b' and c' in FIG. 17, respectively. As is apparent from FIG. 18, the temperature at each point rises as the plasma jet 437' gets closer to the point because of the movement of the plasma spraying torch 436'. The maximum temperature is obtained at the time when the plasma jet 437' passes immediately above the point, and the temperature decreases as the plasma jet 437' moves away from the point.

A gradient of rise and fall of the above-mentioned temperature profile becomes steeper as the heat moves more rapidly to the mounting table 433'. Therefore, the difference between the maximum temperature in the bottom face of the substrate (the temperature when the plasma spraying torch positions immediately above the point) and the temperature after the plasma spraying torch 436' passes the point, that is, Tgap' in FIG. 18, becomes extremely large. The wide difference in temperature generates a thermal stress between the region in which a spraying process is being conducted and the other region on the substrate 433'. The thermal stress acts on the glass substrate 432', thereby breaking the glass substrate 432'.

In such a conventional method, since the heat quickly moves to the mounting table 433' side, the value of the maximum temperature Tmax in the bottom face of the glass substrate 432' can be lowered. On the front surface of the glass substrate 432', however, there still remains a region where the temperature reaches an extremely high level because of momentary application of a large heat load and poor thermal conductivity of glass. Accordingly, the temperature difference between the front surface and the bottom face of the glass substrate 432' becomes large. As a result, the thermal pressure may bring about breaking of the glass substrate 432'.

In Example 7 of the present invention shown in FIG. 15, in order to solve the above-mentioned problems of a conventional method, the components are configured so that a heat load applied to the glass substrate 432 from the plasma spraying torch 436 is not suddenly released to the mounting table 433 side. Specifically, an abrupt change in temperature as in the conventional example is inhibited by providing the thin air layer 435 between the mounting table 433 and the glass substrate 432.

Figure 16:
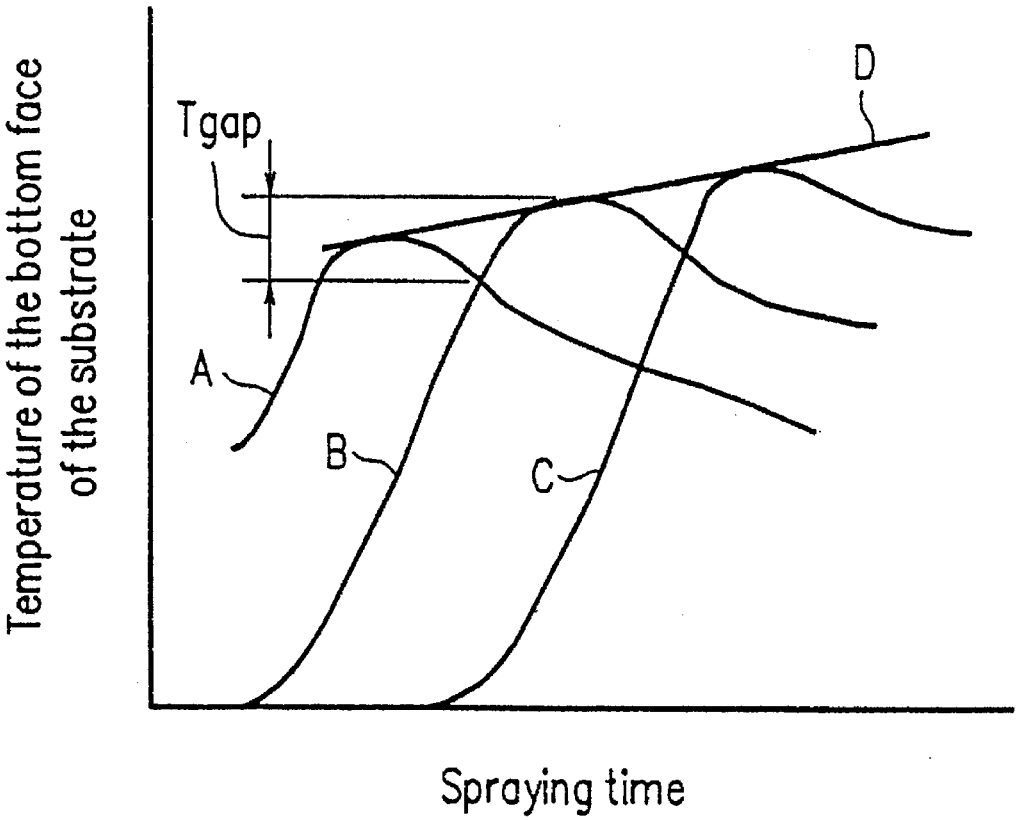
FIG. 16 is a graph showing the change in substrate temperatures in the plasma spraying process shown in FIG. 15.

FIG. 16 is a graph showing the change in temperature of the bottom face of the glass substrate 432 at points a, b and c in FIG. 15, respectively. Similarly to FIG. 18, the ordinate corresponds to time in which the spraying has been proceeded, and the abscissa represents the temperature of each point. Specifically, curves A, B and C of FIG. 16 show temperature variations at the points a, b and c in FIG. 15, respectively.

As is apparent from FIG. 16, even if distances between the points a, b and c in FIG. 15 are equalized to those between the points a', b', and c' in FIG. 17, the temperature variation profiles as indicated by the curves A, B and C, respectively, are obtained. As a result, the difference between the maximum temperature on the bottom face of the substrate (temperature at the time when the plasma spraying torch positions immediately above the point) and the temperature after the plasma spraying torch 436 passes the point, that is Tgap in FIG. 16 is smaller than the similar temperature difference Tgap' in a conventional method. The breaking of the glass substrate 432 due to the temperature difference Tgap does not occur. The temperature difference Tgap is small because the air layer 435 between the glass substrate 432 and the mounting table 433 acts as a heat insulating layer so as to inhibit the heat from rapidly moving to the mounting table 433 side.

The air layer 435 constitutes a closed space between the mounting table 433 and the glass substrate 432. When an open space is formed, a free convection is generated by the rise in the temperature of the bottom face of the glass substrate 432. As a result, heat transfer to the mounting table 433 is accelerated, thereby inhibiting heat insulating effects. Even in the case where the closed space is constituted, if the thickness of the air layer 435 is too large, the free convection is generated. As a result, sufficient heat insulating effects cannot be obtained. Therefore, in order to obtain good heat insulating effects, the thickness of the air layer 435 is preferably about 1 mm or less.

Alternatively, other heat insulating means such as a heat insulating board made of a material excellent in heat insulating properties may be provided instead of the air layer 435.

Next, the effect of accumulation of heat on the glass substrate, which is coherent to the spraying process, will be described.

As can be seen from FIG. 16, as the plasma spraying process proceeds, the maximum temperature on the surface of the glass substrate 432 gradually rises as indicated with a solid line D in FIG. 16. This is because heat attendant on spraying is gradually accumulated in the glass substrate 432 due to the heat insulating effect. The rise in temperature of the glass substrate 432 due to the accumulation of heat inevitably changes the surface condition of the glass substrate 432 which is subject to spraying as the film deposition by spraying proceeds.

Figure 19:
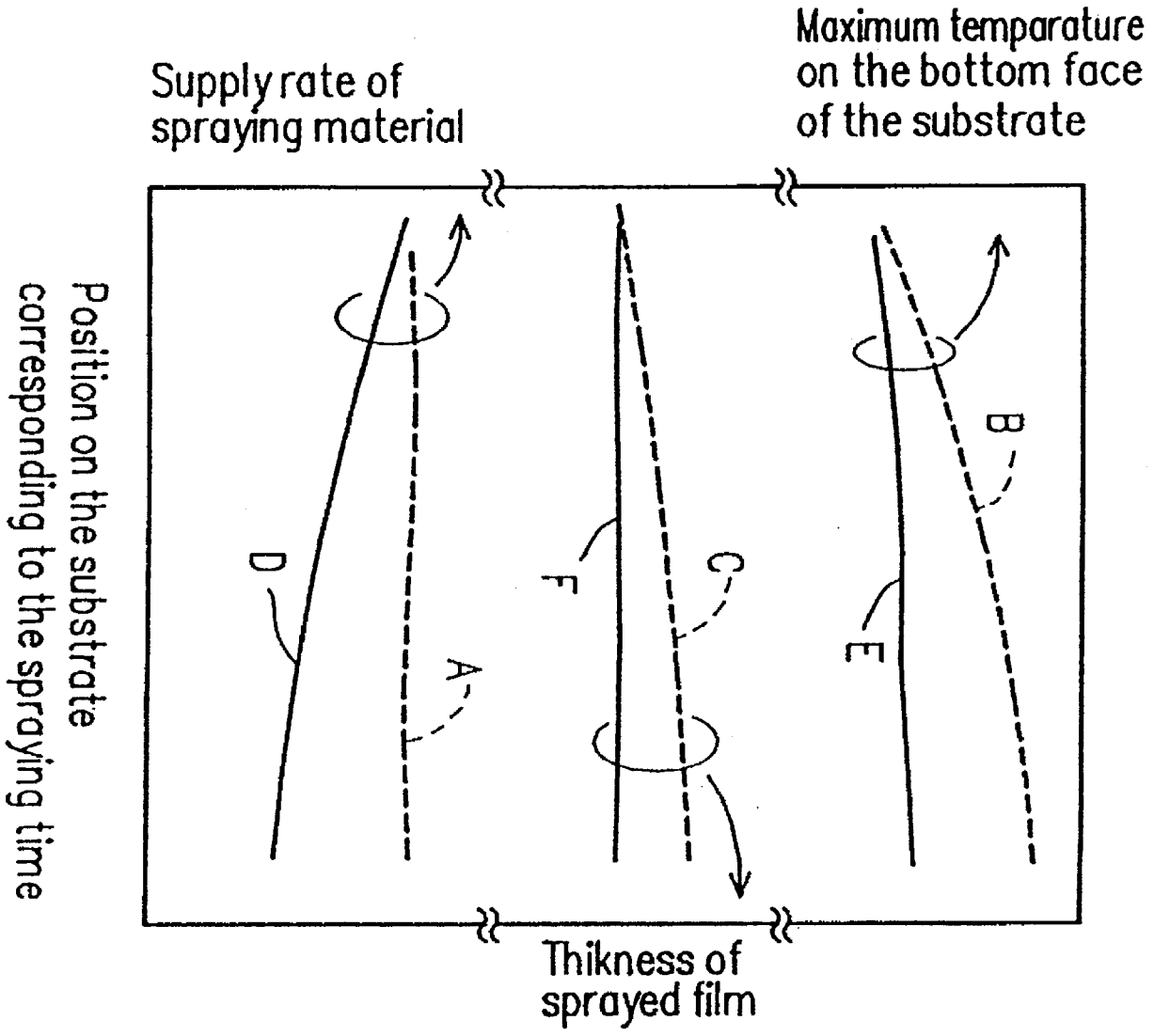

FIG. 19 shows the relationship between the substrate temperature, the thickness of the sprayed film, the supply rate of the material to be sprayed and the elapsed spraying time period in the case where the cathode lines are formed on the glass substrate by plasma spraying. Specifically, the abscissa in FIG. 19 represents the position of the cathode line on the glass substrate 432, which corresponds to an elapsed spraying time. Curves B and E represent the maximum temperatures on the bottom face of the glass substrate 432 at the respective positions, and curves C and F represent the thicknesses of sprayed films (cathode lines) to be formed. Curves A and D show the amounts of supply of the sprayed material from the plasma spraying torch per time unit (i.e., the supply rate of the spraying material). In each of the data, the curves B, C and A in broken lines show the results in the conventional method, and solid lines E, F and D show the results in Example 7 of the present invention, respectively.

In a conventional method, the supply rate of the spraying material from the plasma spraying torch is generally constant as indicated with the curve A regardless of elapsed time of the spraying process. The moving rate of the glass substrate or the plasma spraying torch is generally kept constant. On the other hand, the maximum temperature on the glass substrate gradually rises as the spraying time elapses as indicated with the curve B. If the supply rate of the spraying material from the plasma spraying torch is constant, the thickness formed by spraying gradually increases as indicated with the curve C. This is because the adhering efficiency of metal aluminum particles used as a sprayed material in example 7 increases as the substrate temperature rises. As a result, the sprayed film (cathode lines) cannot be uniformly formed over the entire surface of the glass substrate.

Thus, in Example 7, the supply rate of the spraying material from the plasma spraying torch is gradually decreased as the spraying process elapses as indicated with the curve D. Thus, the amount of heat transferred to the glass substrate by the plasma jet gradually decreases, and the maximum temperature of the substrate is inhibited from rising as indicated with the curve E. As a result, the thickness of the film formed by the spraying is kept constant as indicated with the curve F regardless of the elapse of the spraying process.

As a specific method for reducing the supply rate of the sprayed material from the plasma spraying torch, a method for reducing the output of the plasma jet or a method for reducing the amount of supply of the sprayed material is applicable. Alternatively, when the amount of supply of the sprayed material for a unit area of the glass substrate is relatively reduced by accelerating the moving rate of the plasma spraying torch or the glass substrate, it is also possible to obtain an effect equivalent to that obtained in the case where the supply rate of the spraying material from the plasma spraying torch is gradually reduced. In Example 7, the supply rate of the spraying material is controlled by controlling the moving rate of the plasma spraying torch or the glass substrate, which can be relatively easily realized.

As described above, according to the present invention, cathode lines of a DC gas discharge type image display apparatus are formed by a spraying method. When the cathode lines are formed by a screen printing method which is a conventional method, glass frit (metal paste for printing), which is a non-conductive material, inevitably enters the cathode lines. As a result, the electrical resistivity of the cathode lines increases. On the other hand, the cathode lines formed by the spraying method according to the present invention are mainly constituted by pure metal particles (sprayed particles), except for a small amount of oxide. Therefore, the line resistance thereof is greatly lowered. With the reduced line resistance, in the case where the display apparatus is driven either by a refresh driving method or by a memory driving method, the deterioration of quality of an image, which results from such reasons as uneven luminance of the display screen, unlighted pixels and a reduced memory margin due to a voltage drop along the cathode line, can be prevented. In particular, since the memory margin can be reserved over a long period of time and variation in the driving voltage can be limited to a small value as compared with the method adopting screen printing, the reliability as a display apparatus is remarkably improved.

When grooves are formed into a predetermined pattern on the surface of a front glass substrate and the cathode lines are formed on the bottom faces of the grooves, the constituting material of the cathode lines are not scattered over a large area even in the case where the discharge repeatedly occurs. Therefore, the discharge area is not increased as a discharge time elapses. As a result, a stable operation of a display apparatus can be obtained over a long time period by inhibiting the discharge voltage caused by such an expansion in the discharge area.

When the spraying process is carried out, an average diameter d of a primary particle of the cathode material (spraying material) to be supplied to a spraying apparatus is set so as to be in a certain range, in which the upper limit thereof is a smaller value of h/2 and W/9 and the lower limit thereof is 10 μm, for a width W and a thickness h of the cathode line to be formed. Then, the sprayed particles are adhered to the surface of the glass substrate in such a state that a sprayed particle is flattened so as to have a diameter about three times the average diameter d of the primary particle. As a result, such a fine sprayed film that adhesion with the glass substrate is sufficiently preserved and an electrical resistivity is reduced to an extremely low level can be obtained.

When the plasma spraying is executed as a spraying process, cathode lines having a fine pattern can be formed so as to be minute and to have strong adhesion to the glass substrate. Moreover, in the plasma spraying, a wide variety of materials can be processed with good controllability. Therefore, cathode lines having more excellent characteristics can be formed with high reproducibility.

Moreover, the cathode lines formed in accordance with the present invention may have the structure consisting of a metal bus line and an upper coating formed on the surface thereof. In the cathode lines thus structured, the resistivity of the cathode lines can be reduced by the metal bus line. Simultaneously, the discharge contraction is inhibited by selecting a material having a small sputtering rate as a material for the upper coating.

When a baking process is further carried out after forming the cathode lines by spraying, the sprayed film (cathode lines) is more finely formed, thereby realizing further reduction in the resistivity of the cathode lines.

When the surface of the glass substrate corresponding to the portions where the cathode lines are to be formed is roughened prior to forming the cathode lines by spraying, the adhesion between the sprayed film (cathode lines) and the glass substrate becomes stronger. As a result, even if any mechanical load is applied to the sprayed film, accompanying handling and the like during the fabrication process, problems such as pealing off of the sprayed film (cathode lines) or disconnection thereof do not occur.

When grooves are formed on the surface of the glass substrate corresponding to the portions where the cathode lines are to be formed and the cathode lines are formed on the bottom faces of the grooves by spraying, the material constituting the cathode lines is not scattered over a large area even in the case where the discharge repeatedly occurs. Consequently, the discharge area is not increased as the discharge process elapses. As a result, the operation of the display apparatus is stabilized over a long period of time by inhibiting the discharge voltage from varying due to an expansion in the discharge area (i.e., the area involved in the discharge).

When the spraying process is conducted in such a state that the glass substrate which is subject to spraying is placed on a mounting table via a heat insulating means, the heat which is given to the glass substrate by spraying can be prevented from rapidly transferring to the mounting table. As a result, a temperature difference between the region in which spraying is being conducted and the other region is reduced, thereby reducing a heat load applied to the glass substrate on the surface of the glass substrate. Consequently, the glass substrate is prevented from being broken due to the heat load.

Adhesion efficiency of the sprayed material to the glass substrate gradually increases as the substrate temperature rises. When the deposition rate of the sprayed film is kept substantially constant during the elapse of the spraying time by controlling the supply rate of material to be sprayed from the spraying torch, or the moving rate of at least one of the spraying torch or the glass substrate, the sprayed film (cathode lines) having a substantially uniform thickness can be formed even in the case where the substrate temperature gradually rises due to the accumulation of heat in the glass substrate which is subject to spraying as the spraying time elapses. As a result, even in the case where a large-sized display apparatus is formed, a uniform sprayed film (cathode lines) can be formed over the entire display screen of a large area.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A DC gas discharge type image display apparatus comprising:

a front glass substrate;

a rear glass substrate facing the front glass substrate, interposing a discharge gas therebetween;

a set of anodes including a plurality of line electrodes formed on the rear glass substrate;

a set of cathodes including a plurality of line electrodes placed on the front glass substrate so as to perpendicularly cross the set of anodes; and a plurality of discharge cells, each being provided so as to correspond to each of cross points of the set of anodes and the set of cathodes, wherein the line electrodes included in the set of cathodes are formed by a spraying method for spraying particles of a predetermined cathode material from a spraying device toward a glass substrate, wherein the cathode material is selected so that an average diameter d of a primary particle supplied to the spraying device is set in a range, upper limit thereof being a smaller value of h/2 and W/9 and lower limit thereof being 10 μm, where each of the line electrodes included in the set of cathodes has a width W and a thickness h.

2. A DC gas discharge type image display apparatus according to claim 1, wherein the line electrodes included in the set of cathodes are formed on bottom faces of grooves which are formed on a surface of the front glass substrate.

3. A DC gas discharge type image display apparatus according to claim 1, wherein the spraying method is a plasma spraying method.

4. A DC gas discharge type image display apparatus according to claim 1, wherein the cathode material is selected from a group consisting of aluminum, nickel, an aluminum alloy and a nickel alloy.

5. A DC gas discharge type image display apparatus according to claim 1, wherein the discharge gas is a mixed gas of He and Xe.

6. A DC gas discharge type image display apparatus according to claim 1, wherein each of the line electrodes included in the set of cathodes includes:

a metal bus line formed by the spraying method; and an upper coating film made of a material selected from a group consisting of a metal, a metallic oxide and a metallic sulfide, the upper coating film being formed on a surface of the metal bus line.

7. A DC gas discharge type image display apparatus according to claim 6, wherein the upper coating film is formed by the spraying method.

8. A DC gas discharge type image display apparatus according to claim 6, wherein the oxide is $La_{1-x}Sr_xMo_3$ (where M is Co or Mn) having a perovskite structure.

9. A DC gas discharge type image display apparatus according to claim 1, wherein each of the line electrodes included in the set of cathodes is formed by laminating sprayed particles of the cathode material in a flattened manner.

10. A DC gas discharge type image display apparatus according to claim 6, wherein the metal bus line is formed by laminating sprayed particles in a flattened manner.

11. A DC gas discharge type image display apparatus according to claim 1, wherein the set of cathodes are formed by further being subject to a baking process at a temperature of 400° C. or higher after execution of the spraying method.

12. A DC gas discharge type image display apparatus comprising:

a front glass substrate;

a rear glass substrate facing the front glass substrate, interposing a discharge gas therebetween;

a set of anodes including a plurality of line electrodes formed on the rear glass substrate;

a set of cathodes including a plurality of line electrodes placed on the front glass substrate so as to perpendicularly cross the set of anodes; and a plurality of discharge cells, each being provided so as to correspond to each of cross points of the set of anodes and the set of cathodes, wherein the line electrodes included in the set of cathodes are formed by a spraying method for spraying particles of a predetermined cathode material from a spraying device toward a glass substrate, wherein the cathode material is selected so that an average diameter d of a primary particle supplied to the spraying device is set in a range, upper limit thereof being a smaller value of h/2 and W/9 and lower limit thereof being 10 μm, where each of the line electrodes included in the set of cathodes has a width W and a thickness h, and d is about 20 μm or smaller.

13. A DC gas discharge type image display apparatus comprising:

a front glass substrate;

a rear glass substrate facing the front glass substrate, interposing a discharge gas therebetween;

a set of anodes including a plurality of line electrodes formed on the rear glass substrate;

a set of cathodes including a plurality of line electrodes placed on the front glass substrate so as to perpendicularly cross the set of anodes; and a plurality of discharge cells, each being provided so as to correspond to each of cross points of the set of anodes and the set of cathodes, wherein the line electrodes included in the set of cathodes are formed by a spraying method for spraying particles of a predetermined cathode material from a spraying device toward a glass substrate, wherein the cathode material is selected so that an average diameter d of a primary particle supplied to the spraying device is set in a range, upper limit thereof being a smaller value of h/2 and W/9 and lower limit thereof being 10 μm, where each of the line electrodes included in the set of cathodes has a width W and a thickness h, and W is 150 μm or less and h is 10 μm to about 30 μm.

* * * * *